US007821351B2

(12) United States Patent
Furuta et al.

(10) Patent No.: US 7,821,351 B2
(45) Date of Patent: Oct. 26, 2010

(54) IRREVERSIBLE CIRCUIT ELEMENT

(75) Inventors: Takayuki Furuta, Yokosuka (JP); Atsushi Fukuda, Yokohama (JP); Hiroshi Okazaki, Zushi (JP); Shoichi Narahashi, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 179 days.

(21) Appl. No.: 11/846,721

(22) Filed: Aug. 29, 2007

(65) Prior Publication Data

US 2008/0309426 A1 Dec. 18, 2008

(30) Foreign Application Priority Data

Aug. 31, 2006 (JP) ..... 2006-236277
May 31, 2007 (JP) ..... 2007-145685

(51) Int. Cl.
*H01P 1/36* (2006.01)

(52) U.S. Cl. ..... 333/24.2; 333/1.1

(58) Field of Classification Search ..... 333/1.1, 333/24.2

See application file for complete search history.

(56) References Cited

U.S. PATENT DOCUMENTS

| | | | |
|---|---|---|---|
| 3,605,040 | A | 9/1971 | Knerr et al. |
| 2001/0028280 | A1 | 10/2001 | Maruhashi et al. |
| 2002/0185659 | A1 | 12/2002 | Yamaguchi et al. |

FOREIGN PATENT DOCUMENTS

| | | | |
|---|---|---|---|
| JP | 9-93003 | | 4/1997 |
| JP | 4240780 | | 1/2009 |
| KR | 1997-0008233 | | 2/1997 |
| KR | 10-0216481 | | 8/1999 |
| WO | WO 02/084783 | A1 | 10/2002 |

OTHER PUBLICATIONS

Ichiro Ikushima, et al. "A Temperature-Stabilized Broad-Band Lumped-Element Circulator" IEEE Transactions on Microwave Theory and Techniques, vol. MTT-22, No. 12, Dec. 1974, pp. 1220-1225.

Hideto Horiguchi, et al. "Out-band Attenuation Enchancement and Bandwidth Enlargement in a Small Isolator" Hitachi Metals Technical Review, vol. 17, 2001, pp. 57-62 (with Partial English Translation).

*Primary Examiner*—Stephen E Jones
(74) *Attorney, Agent, or Firm*—Oblon, Spivak, McClelland, Maier & Neustadt, L.L.P.

(57) ABSTRACT

An irreversible circuit element is configured by including a magnetic substance, a plurality of central conductors L1 to L3, one ends of which are connected to different input/output ports, arranged on the magnetic substance so as to intersect each other while being insulated from each other, a first conductor P1 connected to the other ends of all the central conductors L1 to L3, a second conductor, a plurality of matching capacitors (each configured by C1 to C3) connecting the one end of the central conductors L1 to L3 and the second conductor and a variable matching mechanism V1, one end of which is connected or integrated with the second conductor, capable of changing reactance between the one end and the other end thereof.

37 Claims, 30 Drawing Sheets

PRIOR ART

PRIOR ART

IRREVERSIBLE CIRCUIT ELEMENT

CROSS-REFERENCE TO RELATED APPLICATIONS

This application is based upon and claims the benefit of priority from prior Japanese Patent Application No. 2006-236277, filed Aug. 31, 2006 and Japanese Patent Application No. 2007-145685, filed May 31, 2007, the entire contents of each are incorporated herein by reference.

BACKGROUND ART

The present invention relates to a circuit element using a magnetic substance, and more particularly, to an irreversible circuit element.

A lumped-element type irreversible circuit element can be configured in a small structure, and has therefore been used as an isolator or a circulator for mobile communication equipment and a terminal thereof early on. The isolator is arranged between a power amplifier and antenna in a transmission stage of communication equipment, used for the purpose of preventing a back flow of unnecessary signals from the antenna of a desired frequency band to a power amplifier and stabilizing impedance of the power amplifier on the load side or the like and the circulator is used for a transmission/reception branching circuit or the like.

FIG. 29 is a see-through perspective view illustrating the inner structure of a conventional lumped-element type isolator (hereinafter, simply referred to as an "isolator") 100. Furthermore, FIG. 30 is a circuit diagram showing an equivalent circuit of FIG. 29. The equivalent circuit shown in FIG. 30 omits the description of a ferrite plate F1.

As illustrated in FIG. 29, the conventional isolator 100 is made up of three sets of central conductors L1, L2, L3 (each made up of two linear conductors, both ends of which are short-circuited) which are electrically insulated and superimposed so as to intersect each other at an angle of 120 degrees, interposed between a ferrite plate F1 and a ferrite plate F2 (not shown) which is isomorphic to the ferrite plate F1 and permanent magnets (not shown) for magnetizing the ferrite plates F1 and F2 are arranged so as to face each other and sandwich the ferrite plates F1 and F2.

One ends of the respective central conductors L1, L2, L3 are arranged so as to protrude outward from the perimeter of the ferrite plates F1, F2 and those protrusions are connected to signal input/output ports (not shown) and one ends of matching dielectric substrate strips C1, C2, C3 respectively. The other end of each central conductor and the other end of each of the matching dielectric substrate strips C1, C2, C3 are connected to a plane conductor P respectively and the plane conductor P is grounded (not shown). Furthermore, a termination resistor R1 which absorbs a reflected signal is connected to the input/output port of the central conductor L3 and the other end of the termination resistor R1 is grounded (not shown). The central conductors L1, L2, L3 have inductances. Furthermore, the matching dielectric substrate strips C1, C2, C3 together with the central conductors L1, L2, L3 which contact one end thereof and the plane conductor P which contacts the other end thereof each constitute a capacitor (matching capacitor) in an integrated fashion.

In the above described configuration, the isolator 100 displays irreversibility in a certain frequency range by optimizing matching conditions of the matching capacitors or the like, inductances of the central conductors and materials of the ferrite plates F1, F2 or the like. That is, in the frequency range in question, the isolator 100 displays a large attenuation characteristic (isolation) for a signal inputted from the input/output port connected to one end of the central conductor L1 and outputted from the input/output port connected to one end of the central conductor L2, but the isolator 100 has the property of displaying a small attenuation characteristic (or the opposite property thereof) for signals in the direction opposite thereto.

Furthermore, when no termination resistor R1 is provided for the input/output port of the central conductor L3, the isolator 100 becomes a circulator which displays a large attenuation characteristic for a signal inputted from the input/output port connected to one end of the central conductor L1 and outputted from the input/output port connected to one end of the central conductor L2, a signal inputted from the input/output port connected to one end of the central conductor L2 and outputted from the input/output port connected to one end of the central conductor L3 and a signal inputted from the input/output port connected to one end of the central conductor L3 and outputted from the input/output port connected to one end of the central conductor L1, but has the property of displaying a small attenuation characteristic (or the opposite property thereof) for signals in directions opposite thereto.

However, the frequency (operating frequency) bandwidth in which an irreversible circuit element such as a conventional isolator or circulator displays irreversibility is normally a narrow band (e.g., the frequency bandwidth with which it is possible to realize isolation characteristics 20 dB with respect to central frequency 2 GHz is on the order of dozens of MHz).

On the other hand, Non-patent literature 1 discloses a technique for widening the operating frequency bandwidth of an isolator. In this publicly known technique, an inductor and a capacitor are added to the input end of the isolator realizing a characteristic of a fractional bandwidth of 7.7% at central frequency 924 MHz. However, the configuration as described in Non-patent literature 1 with only an inductor and a capacitor added has a limitation in expanding the operating frequency bandwidth from the standpoint of insertion loss or the like and has such a problem that it is not applicable for use in two far-distanced frequency bands.

Furthermore, there is also a technique of providing a plurality of irreversible circuit elements of different operating frequencies and switching between the elements according to the frequency bands used. However, since this technique uses a plurality of irreversible circuit elements, it is difficult to reduce the size of the apparatus. With advanced functionality of portable communication terminal apparatuses in recent years in particular, there is a demand for suppressing the bloating of portable communication terminal apparatuses, and it is difficult to adopt a configuration using a plurality of irreversible circuit elements for such portable communication terminal apparatuses.

Furthermore, Patent literature 1 discloses an irreversible circuit element in which a capacitor for changing the resonance frequency of a resonance circuit is added to the input/output port of each central conductor, an RF switch for disconnecting/connecting this capacitor is provided and the operating frequency is changed through operation of this RF switch. However, this configuration adds capacitors to the input/output ports of the respective central conductors independently, which results in a problem that the number of parts constituting the irreversible circuit element increases.

Non-patent literature 1: "Harmonic Control and Broadening Frequency Bands of Small Isolator" by Hideto Horiguchi, Yoichi Takahashi, Shigeru Takeda, Hitachi Metals Technical Review vol. 17, pp. 58-62, 2001.

Patent literature 1: Japanese Patent Application Laid-Open No. 9-93003

DISCLOSURE OF THE INVENTION

Issues to be Solved by the Invention

The present invention has been implemented in view of the above described problems and it is an object of the present invention to provide an irreversible circuit element capable of obtaining sufficient irreversible characteristics in an arbitrary frequency band as a single unit without considerably increasing the number of parts.

Means to Solve Issues

In order to solve the above described problems, a first invention provides an irreversible circuit element including a magnetic substance, a plurality of central conductors, one ends of which are connected to different input/output ports, arranged on the magnetic substance so as to intersect each other while being insulated from each other, a first conductor connected to the other ends of all the central conductors, a second conductor, a plurality of matching capacitors connecting, for each central conductor, the one end of the central conductor and the second conductor and a first variable matching mechanism, one end of which is connected or integrated with the second conductor, capable of changing reactance between the one end and the other end thereof.

By making it possible to change reactance of the first variable matching mechanism connected in series to the plurality of matching capacitors in this way, matching conditions of the isolator can be switched between a plurality of states. This allows the isolator as a single unit to obtain a sufficient irreversible characteristic in the plurality of frequency bands.

Furthermore, adopting the configuration of connecting the first variable matching mechanism in series to the plurality of matching capacitors can reduce the number of parts compared to the configuration of providing a variable matching mechanism for each matching capacitor.

Furthermore, since the configuration of connecting the first variable matching mechanism in series to the matching capacitor is adopted, it is possible, when viewed from each input/output port, to increase the amount of displacement of the matching condition with respect to the displacement of reactance of the first variable matching mechanism compared to the case where the variable matching mechanism is connected in series to the ends of connection of the plurality of central conductors and parallel to the matching capacitor. As a result, the first invention can increase the variable width of the operating frequency band compared to the case where the variable matching mechanism is connected in series to the ends of connection of the plurality of central conductors and parallel to the matching capacitor.

Furthermore, in the first invention, all impedances between the respective central conductors and the first variable matching mechanism are preferably equal (illustrated in FIG. 21 which will be described later).

Furthermore, in the first invention, all impedances between the respective matching capacitors and the first variable matching mechanism are preferably equal (illustrated in FIG. 22 which will be described later).

As described above, when all impedances are made equal, degradation of passage loss can be suppressed compared to the case where all impedances are not made equal.

Furthermore, in the first invention, the other end of the first variable matching mechanism with respect to the one end on the second conductor and the first conductor are preferably electrically grounded respectively (illustrated in FIG. 8 which will be described later).

Furthermore, in the first invention, the first conductor and the second conductor are preferably connected or integrated with each other and the other end of the first variable matching mechanism with respect to the ends on the first conductor and second conductor are preferably electrically grounded respectively (illustrated in FIG. 9 which will be described later). The configuration of integrating the first conductor and the second conductor in particular can reduce the number of parts.

Furthermore, the first invention preferably further includes a second variable matching mechanism, one end of which is connected or integrated with the first conductor, the other end of which is connected or integrated with the second conductor, capable of changing reactance between the one end and the other end, in which the other end of the first variable matching mechanism with respect to the one end on the second conductor is electrically grounded (illustrated in FIG. 10 which will be described later).

This configuration, when viewed from each input/output port, provides the second variable matching mechanism connected in series to the ends of connection of the plurality of central conductors and parallel to each matching capacitor and the first variable matching mechanism connected in series to the second variable matching mechanism and each matching capacitor, and therefore by controlling reactances of the first and second variable matching mechanisms, it is possible to make a switchover to more operating frequency bands than the configuration of including only one variable matching mechanism. Moreover, in this configuration, even when the first variable matching mechanism and the second variable matching mechanism are assumed to have completely the same configuration, it is possible to make a switchover to more operating frequency bands than the configuration of including only one variable matching mechanism. Providing such commonality among parts brings about advantageous effects of reducing parts cost and reducing parts management cost.

Furthermore, the first invention preferably further includes a second variable matching mechanism, one end of which is connected or integrated with the first conductor and the other end of which is electrically grounded, capable of changing reactance between the one end and the other end, in which the other end of the first variable matching mechanism with respect to the one end on the second conductor is connected to the first conductor (illustrated in FIG. 11 which will be described later).

In this case, when viewed from each input/output port, the first variable matching mechanism and the second variable matching mechanism are connected in series to each matching capacitor and the second variable matching mechanism is connected in series to the ends of connection of the plurality of central conductors, and therefore by controlling reactances of the first and second variable matching mechanisms respectively, it is possible to make a switchover to more operating frequency bands than the configuration having only one variable matching mechanism. Furthermore, according to this configuration, even when the first variable matching mechanism and the second variable matching mechanism are assumed to have completely the same configuration, it is possible to make a switchover to more operating frequency bands than the configuration of including only one variable matching mechanism. Providing such commonality among parts brings about advantageous effects of reducing parts cost and reducing parts management cost.

Furthermore, the first invention preferably further includes a second variable matching mechanism, one end of which is connected or integrated with the first conductor, the other end of which is electrically grounded, capable of changing reactance between the one end and the other end, in which the other end of the first variable matching mechanism with respect to the end on the second conductor is electrically grounded (illustrated in FIG. 12 which will be described later).

In this case, when viewed from each input/output port, the first variable matching mechanism is connected in series to each matching capacitor, the second variable matching mechanism is connected in series to the ends of connection of the plurality of central conductors, the other end of each variable matching mechanism is electrically grounded, and therefore it is possible to make a switchover to more operating frequency bands than the configuration having only one variable matching mechanism.

Furthermore, in the first invention, the first conductor and the second conductor are preferably connected or integrated with each other, a grounding capacitor is connected in series to the other end of the first variable matching mechanism with respect to the ends on the first and second conductors and the other end of the grounding capacitor is electrically grounded (illustrated in FIG. 14 which will be described later).

Furthermore, the first invention preferably further includes a second variable matching mechanism, one end of which is connected or integrated with the first conductor, the other end of which is connected or integrated with the second conductor, capable of changing reactance between the one end and the other end, in which a grounding capacitor is connected in series to the other end of the first variable matching mechanism with respect to the end on the second conductor and the other end of the grounding capacitor is electrically grounded (illustrated in FIG. 15 which will be described later).

Furthermore, the first invention preferably further includes a second variable matching mechanism, one end of which is connected or integrated with the first conductor, capable of changing reactance between the one end and the other end, in which the first conductor is connected to the other end of the first variable matching mechanism with respect to the end on the second conductor and a grounding capacitor which is electrically grounded is connected in series to the other end of the second variable matching mechanism with respect to the end on the first conductor (illustrated in FIG. 16 which will be described later).

Furthermore, the first invention preferably further includes a second variable matching mechanism, one end of which is connected or integrated with the first conductor, capable of changing reactance between the one end and the other end, in which a first grounding capacitor is connected in series to the other end of the first variable matching mechanism with respect to the end on the second conductor, the other end of the first grounding capacitor is electrically grounded, a second grounding capacitor is connected in series to the other end of the second variable matching mechanism with respect to the end on the first conductor and the other end of the second grounding capacitor is electrically grounded (illustrated in FIG. 17 which will be described later).

As described above, the configuration of mounting the grounding capacitor can improve passage loss compared to the configuration without any grounding capacitor.

Furthermore, a second invention provides an irreversible circuit element including a magnetic substance, a plurality of central conductors, one ends of which are connected to different input/output ports, arranged on the magnetic substance so as to intersect each other while being insulated from each other, a first conductor which is connected to the other ends of all the central conductors and electrically grounded, a second conductor which is electrically grounded, a plurality of matching capacitors connected to the ends of the plurality of central conductors, and a plurality of variable matching mechanisms, one ends of which are connected to any one of the matching capacitors, the other ends of which are connected or integrated with the second conductor, capable of changing reactance between the one end and the other end (illustrated in FIG. 13 which will be described later).

In the case of this configuration, by changing reactances of the plurality of variable matching mechanisms separately connected in series to the plurality of matching capacitors, it is possible to switch the matching condition of the isolator to a plurality of states. This allows the isolator as a single unit to obtain a sufficient irreversible characteristic in the plurality of frequency bands.

Furthermore, since the variable matching mechanism is connected in series to the matching capacitor, when viewed from each input/output port, it is possible to increase the amount of displacement of the matching condition with respect to the displacement of reactance of the variable matching mechanism compared to the case where the variable matching mechanism is connected in series to the ends of connection of the plurality of central conductors and parallel to the matching capacitor. As a result, the second invention can increase the variable width of the operating frequency band compared to the case of connecting the variable matching mechanism in series to the ends of connection of the plurality of central conductors and parallel to the matching capacitor.

Furthermore, a third invention provides an irreversible circuit element including a magnetic substance, a plurality of central conductors, one ends of which are connected to different input/output ports, arranged on the magnetic substance so as to intersect each other while being insulated from each other, a first conductor connected to the other ends of the plurality of all central conductors, a second conductor which is electrically grounded, a plurality of matching capacitors connecting, for each of the central conductors, one end of the central conductor and the second conductor and a variable matching mechanism, one end of which is connected or integrated with the first conductor, the other end of which is electrically grounded, capable of changing reactance between the one end and the other end (illustrated in FIG. 3 which will be described later).

Furthermore, in the third invention, a grounding capacitor is preferably connected in series to the other end of the variable matching mechanism and the other end of the grounding capacitor is electrically grounded (illustrated in FIG. 18 which will be described later).

In the case of the configuration of mounting the grounding capacitor in this way, passage loss is improved compared to the configuration with no grounding capacitor mounted.

Furthermore, in the first to third inventions, at least some of the variable matching mechanisms are preferably circuits in which a circuit element having predetermined reactance and a switch are connected parallel to each other and reactance between one end of connection between the circuit element and the switch and the other end of connection is changed by turning ON/OFF the switch (illustrated in FIG. 4 which will be described later). Turning ON/OFF this switch can change the matching condition of the irreversible circuit element of the present invention and using such an irreversible circuit element can switch between the operating frequency bands of the irreversible circuit element.

Furthermore, in the first to third inventions, at least some of the variable matching mechanisms are preferably circuits in which a plurality of series circuits made up of first circuit elements having predetermined reactance and switches connected in series to each other and a second circuit element having predetermined reactance are connected in parallel to each other and reactance between the one end of connection between the series circuits and the second circuit element and the other end of connection is changed by turning ON/OFF each of the switches (illustrated in FIG. 5 which will be described later).

In the case of such a variable matching mechanism, it is possible to operate the switches of the plurality of series circuits which make up the mechanism and switch between three or more types of reactance of the whole variable matching mechanism. The number of switchable types of reactance can be increased by increasing the number of the above described series circuits making up the variable matching mechanism. Furthermore, when the number of series circuits is identical, the case where all types of reactance of the first circuit element making up each series circuit differ is the case where it is possible to maximize the number of switchable types of reactance of the whole variable matching mechanism.

Furthermore, in the first to third inventions, at least some of the variable matching mechanisms are circuits provided with variable capacitors whose capacitance is variable, capable of changing reactance between one end and the other end of the variable capacitor by changing the capacitance of the variable capacitor (illustrated in FIGS. 19, 20 which will be described later). At least some of the variable capacitors are more preferably capacitors made up of the first conductor and the second conductor and capacitance thereof is changed by mechanically changing the distance between the first conductor and the second conductor.

Furthermore, the variable matching mechanism may be a circuit in which one or more series circuits made up of a first circuit element having predetermined reactance and a switch connected in series to each other and a second circuit element having predetermined reactance are connected in parallel to each other, in which reactance between one end of connection between the series circuit and the second circuit element and the other end of connection is changed by turning ON/OFF the switch, and the first circuit element and the second circuit element may also be provided with a capacitor on the side closest to the grounded other end of each variable matching mechanism. Using such a variable matching mechanism for the irreversible circuit element of the present invention can improve passage loss as in the case of the configuration mounted with the grounding capacitor.

When using the capacitor incorporated in the variable matching mechanism in this way as the grounding capacitor, it is possible to perform switching control including the reactance component of the grounding capacitor. Therefore, it is possible to take large switching displacement of the operating frequency band and sufficiently reduce passage loss for each operating frequency band.

Effects of the Invention

As described above, the irreversible circuit element of the present invention can obtain a sufficient irreversible characteristic in an arbitrary frequency band as a single unit without significantly increasing the number of parts.

BEST MODE FOR CARRYING OUT THE INVENTION

Hereinafter, the best modes for carrying out the invention will be explained with reference to the attached drawings. A mode in which the present invention is applied to a lumped-element type isolator which is an example of an irreversible circuit element will be shown below, but the present invention is not limited to this.

First Embodiment

First, a first embodiment of the present invention will be explained. This embodiment is an example of Claim 32.

<Appearance Configuration>

Figure 1:
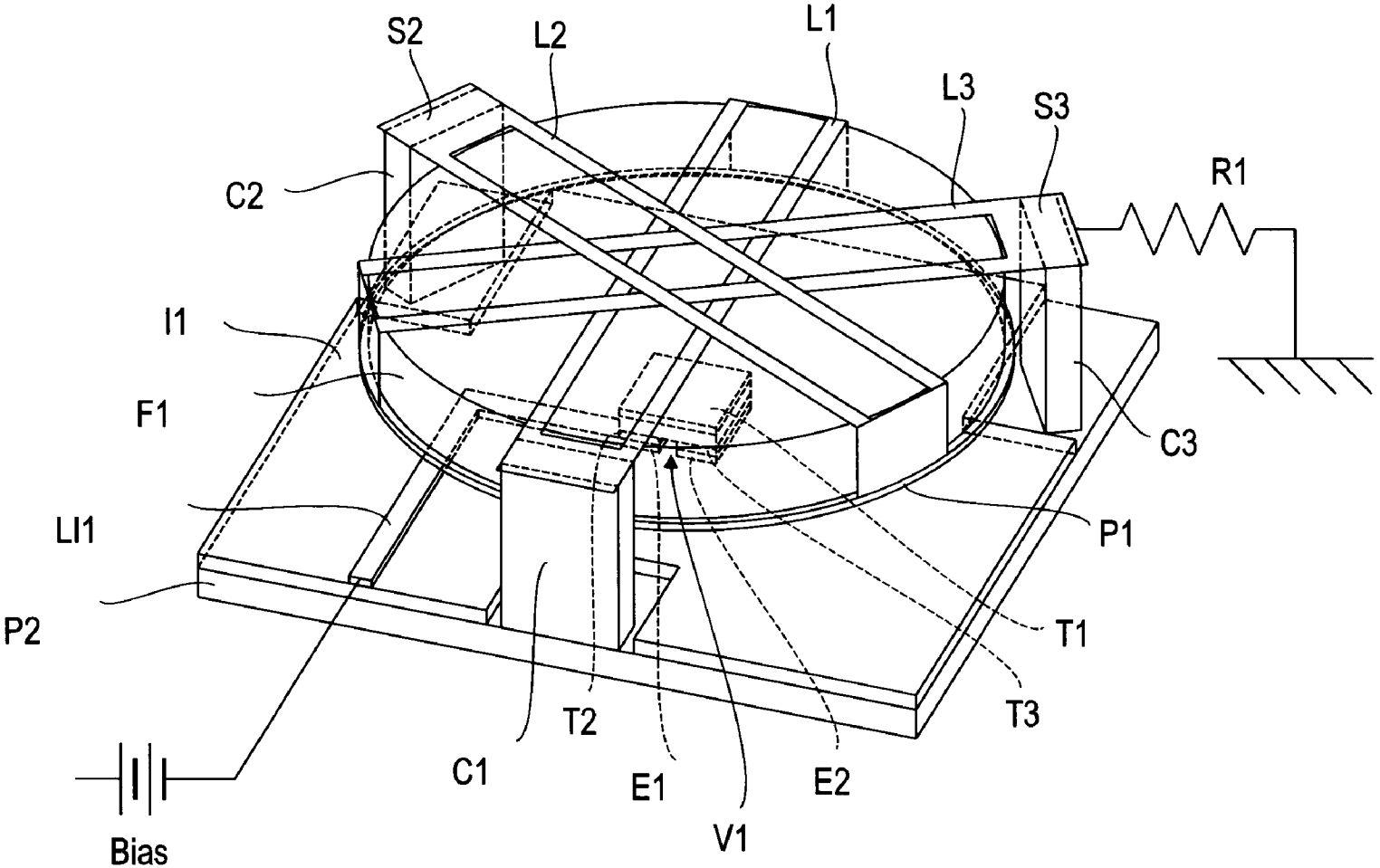
FIG. 1 is a see-through perspective view showing a configuration example of an isolator according to a first embodiment.
Figure 2:
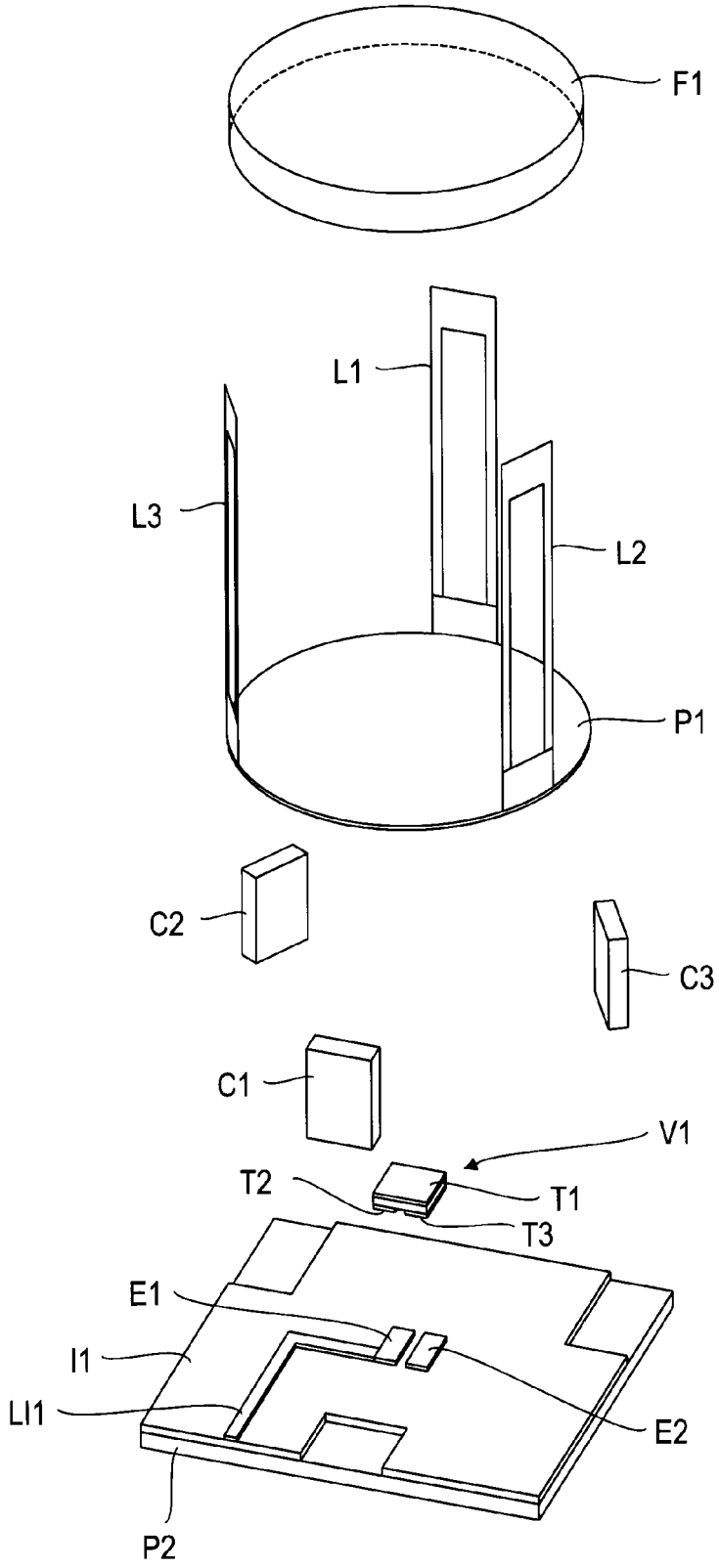
FIG. 2 is an exploded perspective view of the isolator illustrated in FIG. 1.

FIG. 1 is a see-through perspective view showing a configuration example of an isolator 1 according to a first embodiment. Furthermore, FIG. 2 is an exploded perspective view of the isolator 1 illustrated in FIG. 1.

As shown in FIG. 1, the isolator 1 of this embodiment has central conductors L1, L2, L3, matching dielectric substrate strips C1, C2, C3, a ferrite plate (magnetic plate) F1, a termination resistor R1, a plane conductor P1 (first conductor), a plane conductor P2 (second conductor), an insulator film I1, a linear conductor LI1, electrodes E1, E2 and a variable matching mechanism V1. The variable matching mechanism V1 is provided with a terminal T1 on one side and terminals T2, T3 on the opposite side thereof.

The plane conductor P2 is electrically grounded (not shown) and an insulator film I1 is formed on one side (top surface in FIG. 1) of this plane conductor P2. However, the insulator film I1 does not exist at three positions where dielectric substrate strips C1, C2, C3 are arranged and the position where the electrode E2 is formed. Furthermore, the electrode E2 is formed in contact with the plane conductor P2. The linear conductor LI1 to which a DC voltage source (Bias) is connected and the electrode E1 which communicates with the linear conductor LI1 are formed on the surface (top surface in FIG. 1) of the insulator film I1. The electrodes E1, E2 are mutually insulated and are formed at the positions approximate to each other. The terminals T2, T3 of the variable matching mechanism V1 are mounted on the surfaces of the electrodes E1, E2 respectively, and this causes the electrode E1 and the terminal T2 to communicate with each other and the electrode E2 and the terminal T3 to communicate with each other. The variable matching mechanism V1 is a mechanism which can change reactance between the terminal T1 which is one end and the terminal T3 which is the other end thereof. A specific example of this will be described later.

The plane conductor P1 is a disk-shaped conductor configured integral with the central conductors L1, L2, L3 and one ends of the central conductors L1, L2, L3 range with three locations trisecting the perimeter of the plane conductor P1. The disk-shaped ferrite plate F1 (top surface in FIG. 1) is arranged on one side of the plane conductor P1 and the three central conductors L1, L2, L3 are superimposed on each other so as to intersect each other at an angle of 120 degrees on the top surface (top surface in FIG. 1) of the ferrite plate F1. At this intersection, the central conductors L1, L2, L3 are insulated from each other. Furthermore, the surface of the plane conductor P1 on the side where the ferrite plate F1 is not arranged is mounted on the terminal T1 of the variable matching mechanism V1 and this causes the plane conductor P1 to communicate with the terminal T1.

One ends S1, S2, S3 of the central conductors L1, L2, L3 (opposite side of the end of the plane conductor P1) are arranged so as to protrude outward from the perimeter of the ferrite plate F1 and those protrusions are connected to an input/output port (not shown) and the respective other ends of the matching dielectric substrate strips C1, C2, C3, one ends of which are fixed to the plane conductor P2. Furthermore, a termination resistor R1 which absorbs a reflected signal is connected to an input/output port connected to one end S3 of the central conductor L3 and the other end of the termination resistor R1 is grounded (not shown). The central conductors L1, L2, L3 have inductances. Furthermore, the matching dielectric substrate strips C1, C2, C3 united together with the central conductors L1, L2, L3 that contact the one ends thereof and the plane conductor P2 that contacts the other ends thereof constitute a capacitor (matching capacitor).

Furthermore, a ferrite plate F2 which is isomorphic to the ferrite plate F1 is arranged opposite to the ferrite F1 so as to sandwich the intersection of the central conductors L1, L2, L3 and permanent magnets for magnetizing the ferrite plates F1, F2 are arranged opposed to each other so as to sandwich the ferrite plates F1, F2, but these are not shown.

<Circuit Configuration>

Figure 3:
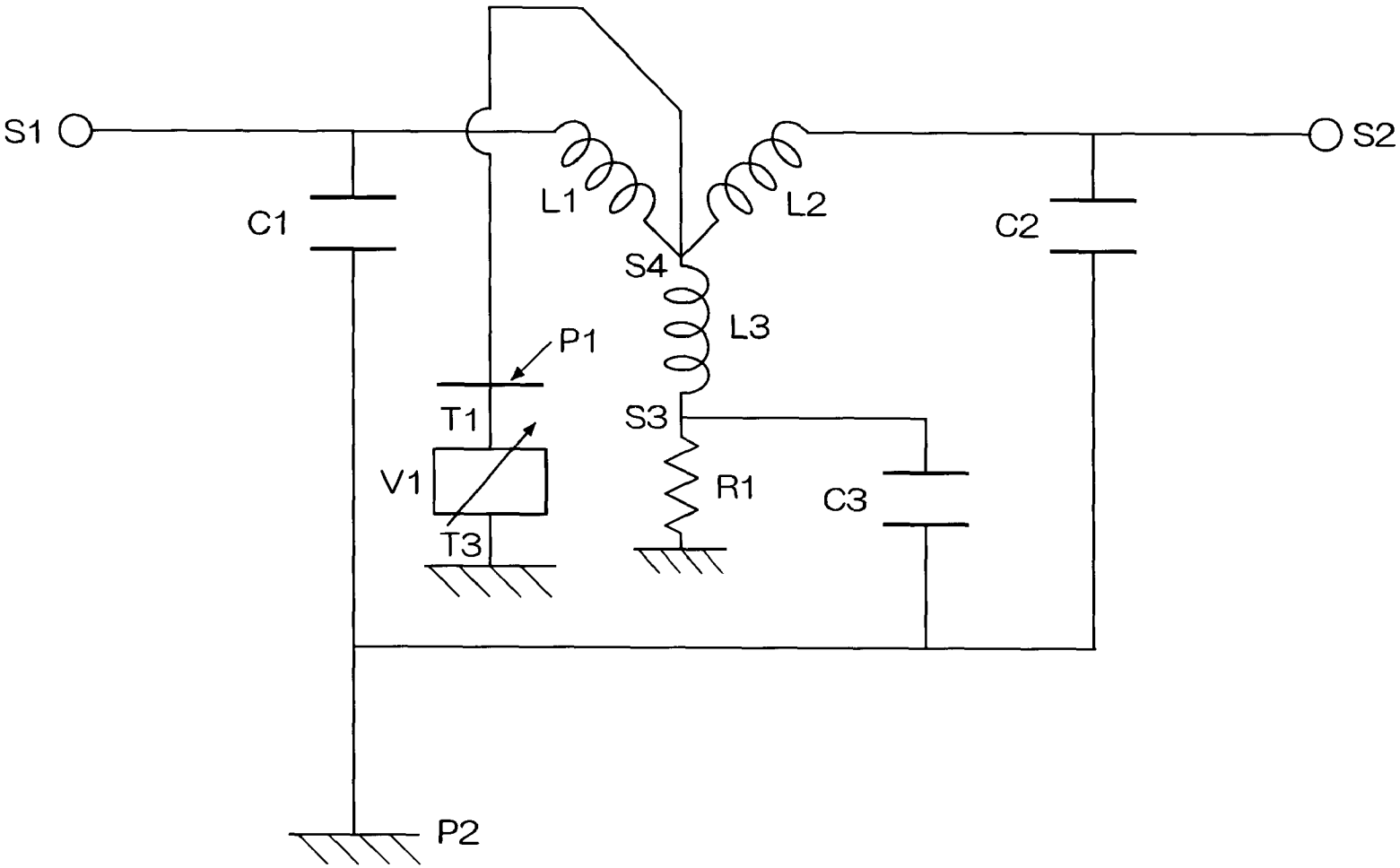
FIG. 3 is an equivalent circuit diagram in the configuration illustrated in FIG. 1.
Figure 4:
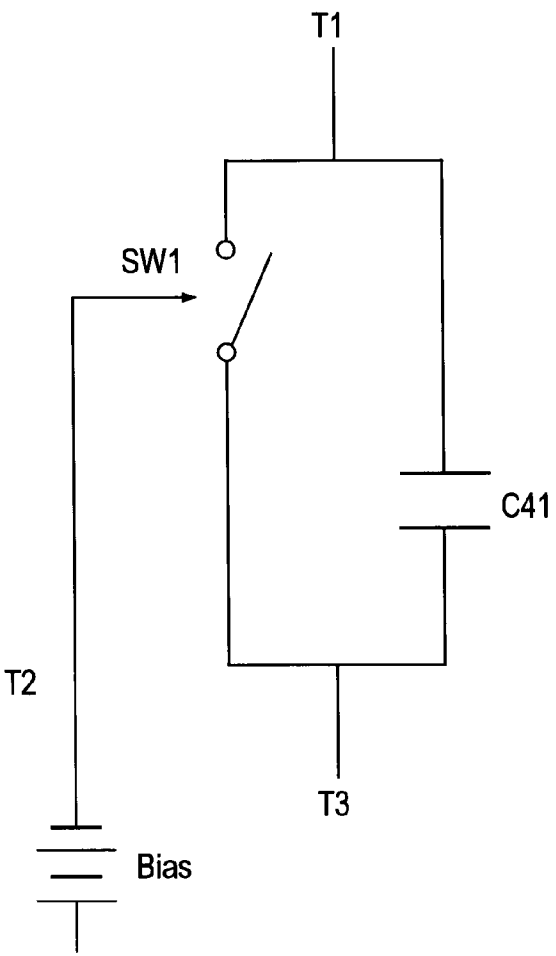
FIG. 4 illustrates an equivalent circuit diagram of a variable matching mechanism V1.

FIG. 3 is an equivalent circuit diagram in the configuration illustrated in FIG. 1. Furthermore, FIG. 4 illustrates an equivalent circuit diagram of the variable matching mechanism V1. The description of the ferrite plate F1 and the descriptions of the linear conductor LI1 and the electrode E1 are omitted in the equivalent circuit shown in FIG. 3. Hereinafter, the equivalent circuit configuration of the isolator 1 of this embodiment will be explained according to FIG. 3.

As illustrated in FIG. 3, other ends of ends S1, S2, S3 of the three central conductors L1, L2, L3 are interconnected and the end of connection S4 thereof is connected to the plane conductor P1. The plane conductor P1 is further connected to the terminal T1 at one end of the variable matching mechanism V1 and the terminal T3 at the other end of the variable matching mechanism V1 is electrically grounded. Matching capacitors made up of the matching dielectric substrate strips C1, C2, C3 respectively are connected to the one ends S1, S2, S3 of the central conductors L1, L2, L3 respectively and the other ends of the respective matching capacitors are connected to the electrically grounded plane conductor P2. Furthermore, the termination resistor R1 is connected to the one end S3 of the central conductor L3 and the other end of the termination resistor R1 is electrically grounded.

As illustrated in FIG. 4, one end of a switch SW1 such as SPST (Single-Pole/Single-Throw Switch) and one end of a capacitor C41 are connected in parallel to the terminal T1 of the variable matching mechanism V1, the other end of the switch SW1 and the other end of the capacitor C41 are connected to the terminal T3 and the terminal T3 is electrically grounded. Furthermore, though the description is omitted in FIG. 3, a DC voltage source (Bias) to drive the switch SW1 is connected to the switch SW1 through the terminal T2 and the switch SW1 is turned ON/OFF by this DC voltage source. This configuration allows the variable matching mechanism V1 to change reactance between the terminal T1 (one end of connection between the switch SW1 and capacitor C41) and the terminal T3 (other end of connection between SW1 switch and C41 capacitor). That is, when the switch SW1 is ON, the terminal T1 and terminal T3 are shorted, the capacitance between the terminals T1 and T3 becomes infinite and reactance between the terminals T1 and T3 becomes 0. On the other hand, when the switch SW1 is OFF, the capacitance between the terminals T1, T3 becomes the same as the capacitance of the capacitor C41 and a reactance component corresponding to the capacitance of the capacitor C41 is generated between the terminals T1, T3.

<Operation>

Next, the operation of the isolator 1 of this embodiment will be explained using the equivalent circuits in FIG. 3 and FIG. 4.

As described above, when the switch SW1 of the variable matching mechanism V1 is ON, the plane conductor P1 is electrically grounded and reactance between the terminal T1 and T3 becomes 0. On the other hand, when the switch SW1 is OFF, the capacitance of the capacitor C41 is applied in series to the plane conductor P1 and the reactance between the terminals T1, T3 also changes accordingly. That is, it is possible to change the matching condition of the isolator 1 in two states through control of the switch SW1 and thereby switch the operating frequency band of the isolator 1 in two ways. By selecting the capacitor C41 as appropriate, it is possible to obtain a sufficient irreversible characteristic in arbitrary two frequency bands using the isolator 1 as a single unit. The relationship between the matching condition of the isolator and an operating frequency band is the contents disclosed in many publicly known literatures such as "Microwave Ferrite and Application Techniques Thereof" by Tadashi Hashimoto, Sougou-Denshi Publications, first edition published on May 10, 1997 and "Basics of Microwave Circuit and Applications Thereof" by Yoshihiro Konishi, Sougou-Denshi Publications, second edition published on Feb. 1, 1992, and therefore explanations thereof will be omitted here.

Furthermore, the configuration of the isolator 1 of this embodiment allows the operating frequency band to be switched in two ways through the configuration of connecting the plane conductor P1 to the end of connection S4 common to the three central conductors L1, L2, L3 and connecting only one variable matching mechanism V1 to the plane conductor P1. Therefore, the number of parts can be reduced compared to the configuration in which variable matching mechanisms (e.g., capacitors) are separately added to the input/output ports of the respective central conductors.

This embodiment has illustrated the configuration using the variable matching mechanism V1 shown in FIG. 4, but instead of this, it is also possible to use as the variable matching mechanism V1 a circuit in which one or more series circuits with a first circuit element having predetermined reactance connected in series to a switch and a second circuit element having predetermined reactance are connected in parallel to each other, in which reactance between one end of the ends of connection between the series circuit and the second circuit element and the other end of these ends of connection is changed turning ON/OFF the switch.

Figure 5:
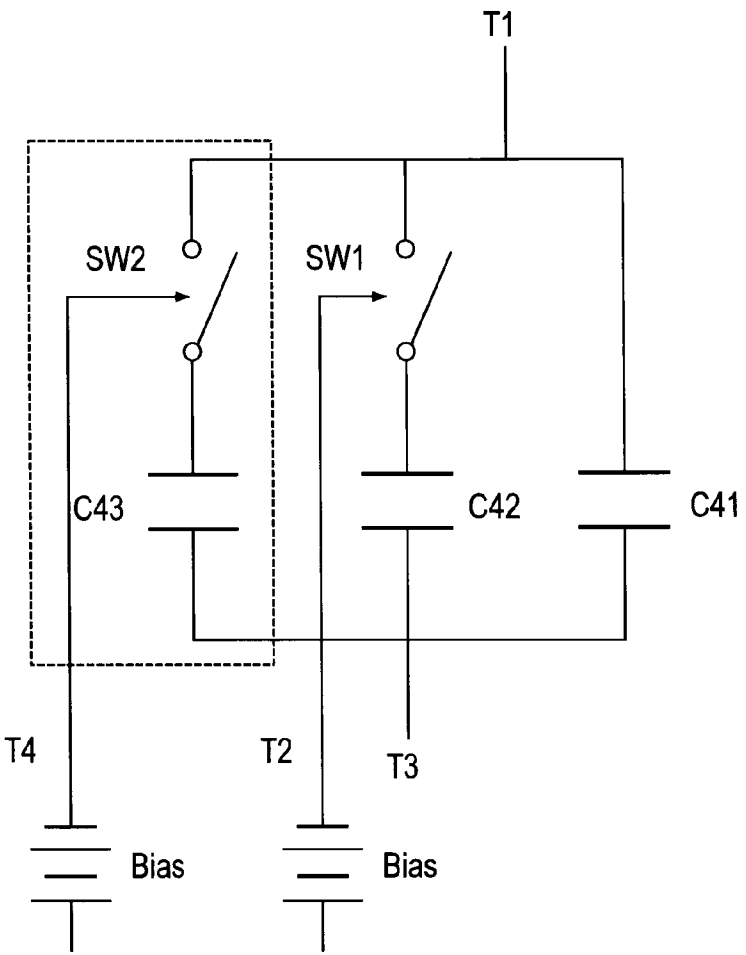
FIG. 5 illustrates an equivalent circuit diagram of the variable matching mechanism V1.

FIG. 5 illustrates the variable matching mechanism V1 in such a configuration. FIG. 5 is an example of a circuit used as the variable matching mechanism V1, in which a series circuit made up of a capacitor C42 and a switch SW1 connected in series to each other, a series circuit made up of a capacitor C43 and a switch SW2 connected in series to each other and a capacitor C41 are connected in parallel to each other, in which reactance between one end (terminal T1) of the ends of connection between the series circuits and the capacitor 41 and the other end (terminal T3) of these ends of connection is changed by turning ON/OFF the switch SW1. The ON/OFF operations of the SW1, SW2 are driven independently by DC voltage sources connected to the terminals T2, T4. In this case, the variable matching mechanism V1 can change reactance between the terminal T1 and terminal T3 through operations of the SW1, SW2. Especially, when all capacitances of the C41, C42, C43 differ from each other, reactance between the terminal T1 and terminal T3 can be changed in four ways. That is, reactance between the terminal T1 and terminal T3 can be changed in four ways; when both the switches SW1, SW2 are ON, when both the switches SW1, SW2 are OFF, when the switch SW1 is ON and the switch SW2 is OFF and when the switch SW1 is OFF and the switch SW2 is ON. This allows the matching condition of the isolator 1 to be changed in four states and allows the operating frequency band to be switched in four ways. That is, by selecting the capacitors C41, S42, S43 as appropriate, the isolator can obtain the sufficient irreversible characteristic in arbitrary four frequency bands as a single unit.

Furthermore, FIG. 5 has shown the configuration in which two series circuits each having a capacitor and a switch connected in series to each other and a capacitor are connected in parallel to each other, but it is also possible to use a variable matching mechanism V1 in a configuration in which three or more similar series circuits and a capacitor are connected in parallel to each other. This makes it possible to realize an operation of making a switchover to more operating frequency bands. In this case, it is preferable to make the capacitances of the capacitors which make up the respective series circuits differ from each other. This is because it is thereby possible to maximize the number of switchable operating frequency bands.

Furthermore, in the configuration of FIG. 5, the series circuit made up of the capacitor C42 and the switch SW1 may be replaced by a configuration with only the switch SW1 (see FIG. 4) and this may be used as the variable matching mechanism V1. In this case, operating frequency bands can be switched in three ways; when the switch SW1 is ON, when both the switches SW1, SW2 are OFF and when the switch SW1 is OFF and the switch SW2 is ON. In the case of this configuration, the number of parts can be reduced compared to the configuration in FIG. 5.

Furthermore, in the configuration in FIG. 4 and FIG. 5, at least some of the capacitors may be replaced by an inductor and this may be used as the variable matching mechanism V1 or an inductor may be connected in series or in parallel to at least some of the capacitors and this may be used as the variable matching mechanism V1.

Furthermore, the configuration of the isolator that realizes the equivalent circuit in FIG. 3 is not limited to the one in FIG. 1. For example, the isolator which has the equivalent circuit in FIG. 3 may also be configured with the modified configurations illustrated in FIGS. 6 and 7.

Figure 6:
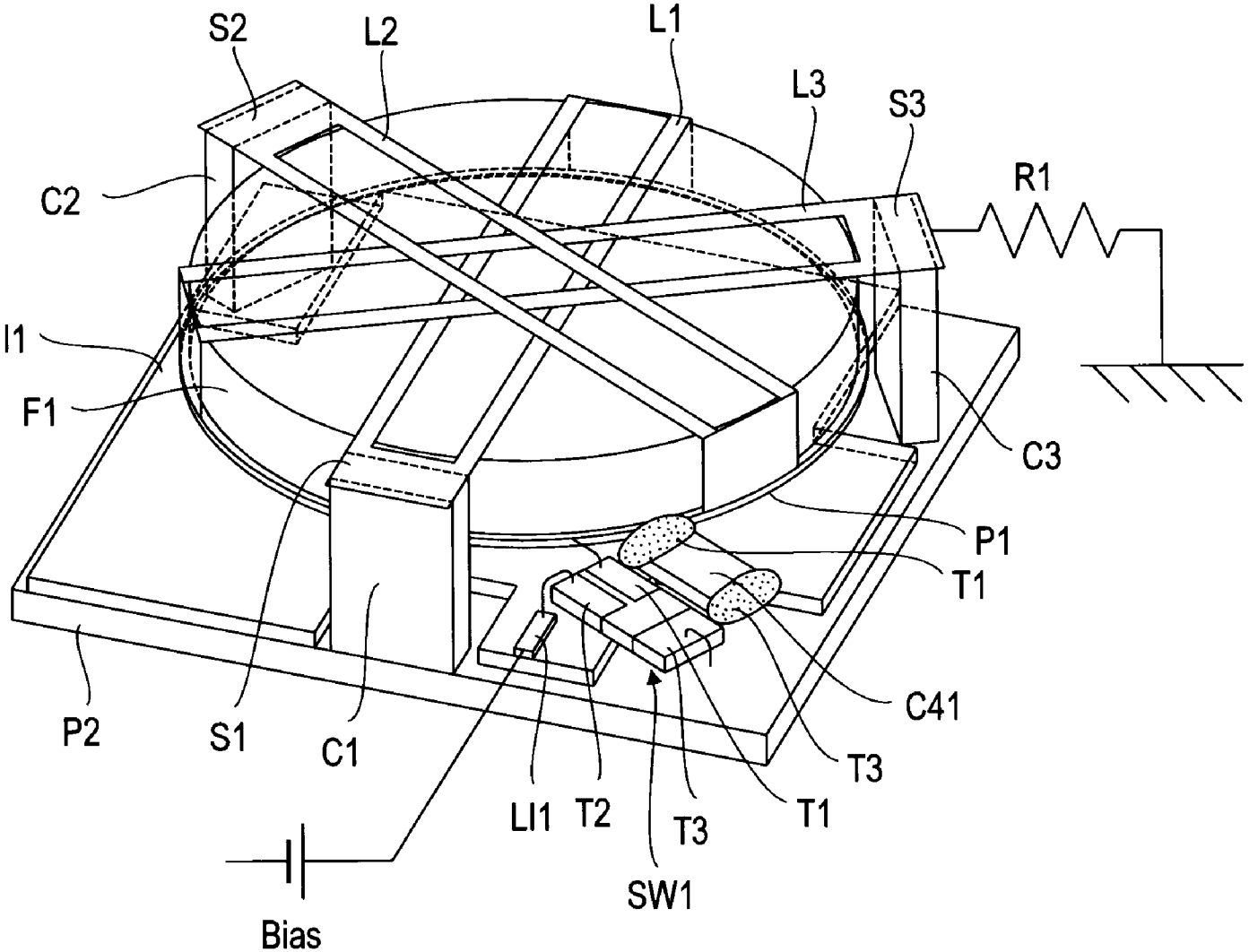
FIG. 6 is a see-through perspective view showing a configuration example of the isolator.
Figure 7:
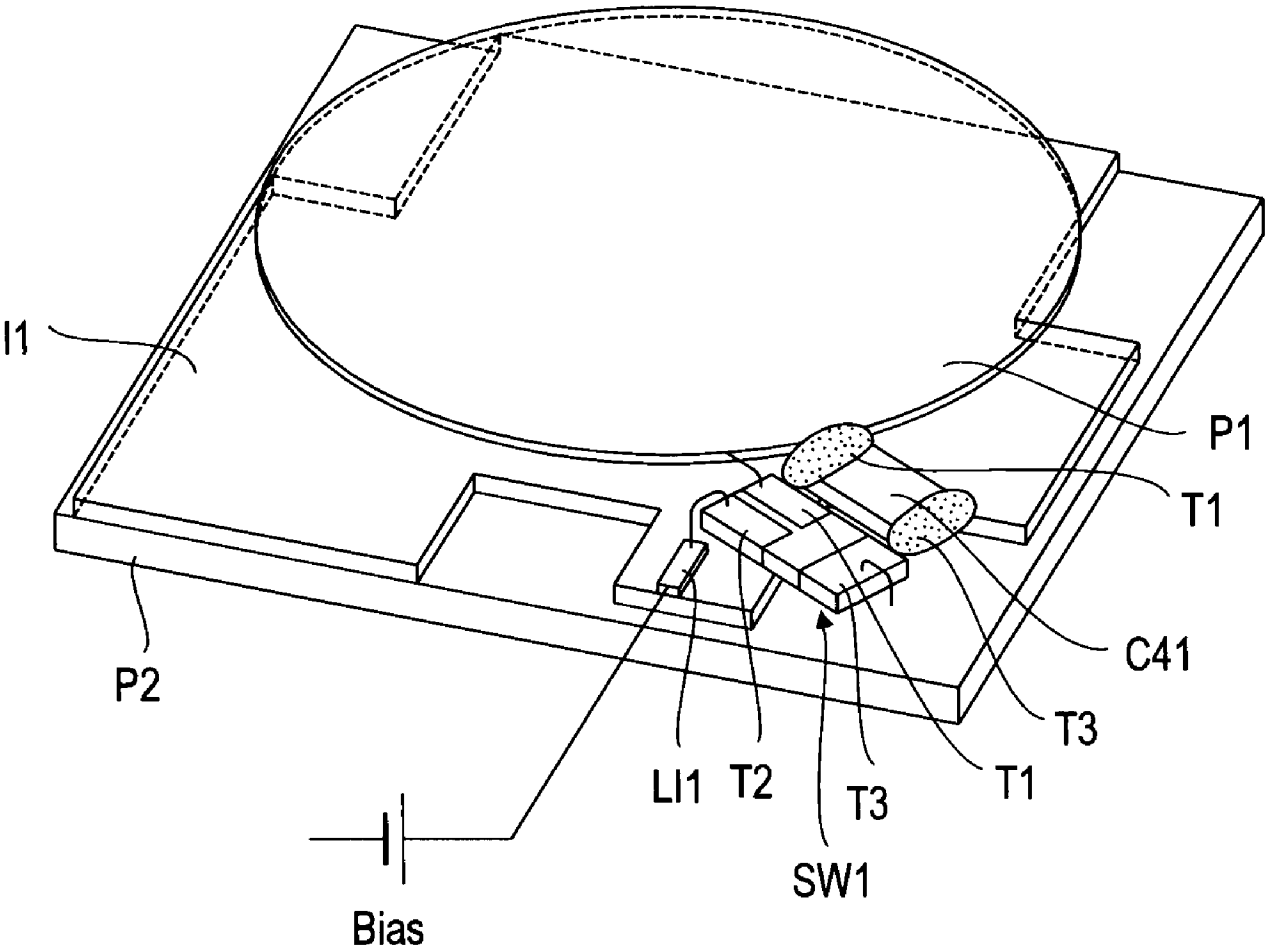
FIG. 7 shows a configuration example of the isolator.

As shown in FIGS. 6 and 7, the isolator in this modified configuration example has central conductors L1, L2, L3, matching dielectric substrate strips C1, C2, C3, a ferrite plate (magnetic plate) F1, a termination resistor R1, a plane conductor P1 (first conductor), a plane conductor P2 (second conductor), an insulator film I1, a linear conductor LI1, a switch SW1 and a capacitor C41. The switch SW1 is provided with terminals T1, T2, T3 and the capacitor C41 is provided with terminals T1, T3. Furthermore, the switch SW1 and the capacitor C41 constitute the variable matching mechanism V1 shown in FIG. 4.

The plane conductor P2 is electrically grounded (not shown) and the insulator film I1 is formed on one side (top surface in FIG. 6) of this plane conductor P2. However, the insulator film I1 does not exist at three positions where the dielectric substrate strips C1, C2, C3 are arranged and near the position of the switch SW1 and the position at which the terminal T3 of the capacitor C41 is arranged. The linear conductor LI1 to which a DC voltage source (Bias) is connected is formed on the surface (top surface in FIG. 6) of the insulator film I1. The plane conductor P1, central conductors L1, L2, L3 and ferrite plate F1 are configured as shown in FIG. 1 and the surface of the plane conductor P1 of the side on which the ferrite plate F1 is not arranged (underside in FIG. 6) is fixed to the surface of the insulator film I1. The switch SW1 and the capacitor C41 are fixed to the surface of the insulator film I1. The terminals T1, T2, T3 of the switch SW1 are connected to the plane conductor P1, linear conductor LI1 and plane conductor P2 respectively by wire bonding or the like. Furthermore, the terminals T1, T3 of the capacitor C41 are connected to the plane conductors P1, P2 respectively by soldering or the like. The rest of the configuration is the same as that in FIG. 1, and therefore explanations thereof will be omitted.

Second Embodiment

Next, a second embodiment of the present invention will be explained. This embodiment is an example of Claims 4 to 6. Hereinafter, only the configuration of an equivalent circuit will be explained. The appearance configuration may be obtained by only modifying the configuration of the first embodiment shown in FIGS. 1 and 6 or the like according to the equivalent circuit shown below (the same will apply to third and subsequent embodiments).

Figure 8:
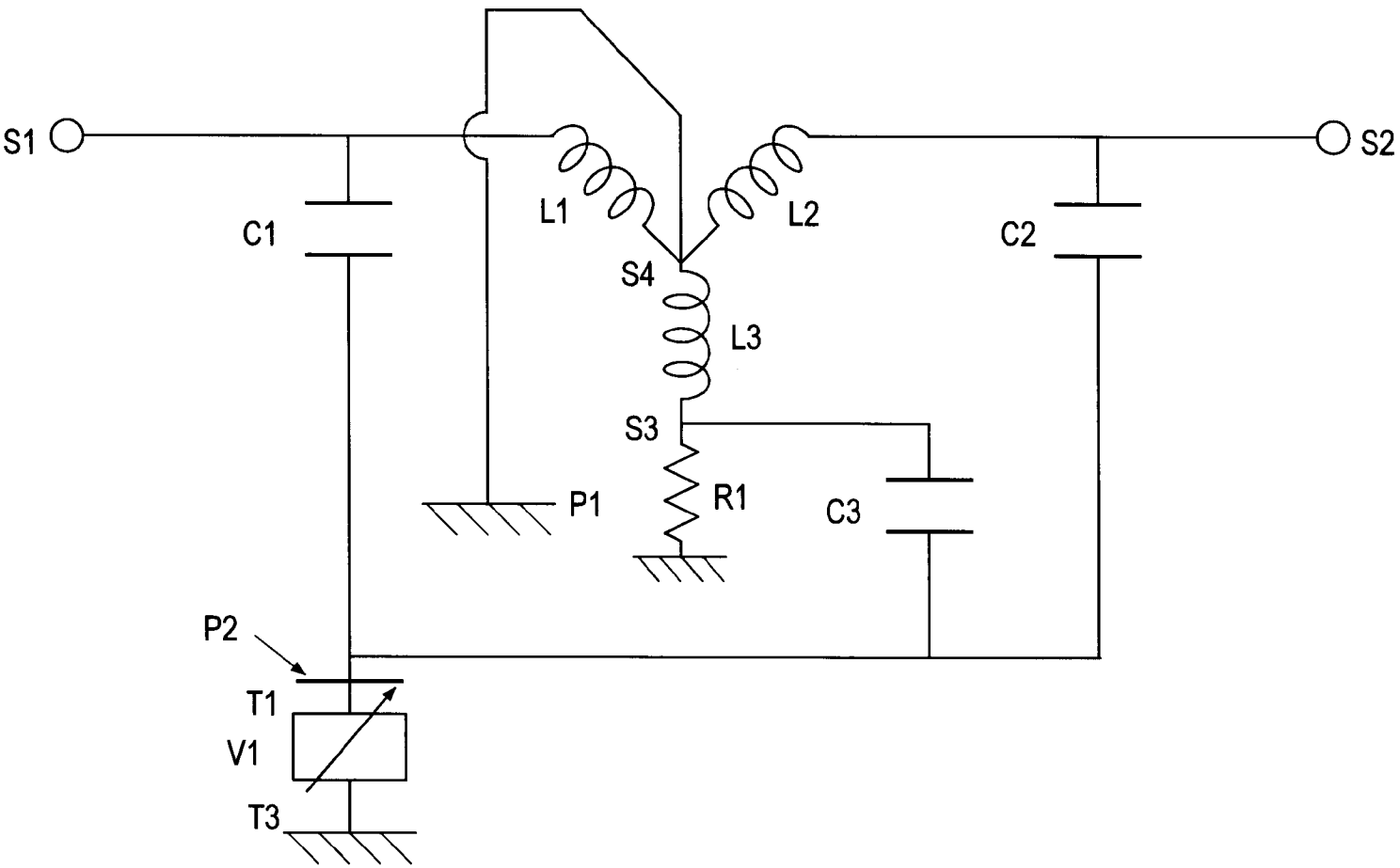
FIG. 8 is an equivalent circuit diagram of an isolator according to a second embodiment.

FIG. 8 is an equivalent circuit diagram of an isolator of this embodiment. As in the case of FIG. 3, the descriptions of a ferrite plate and a DC voltage source to drive a variable matching mechanism V1 will be omitted in FIG. 8.

As illustrated in FIG. 8, in the isolator of this embodiment, the other ends of one ends S1, S2, S3 of three central conductors L1, L2, L3 are interconnected and the end of connection S4 is connected to an electrically grounded plane conductor P1. Matching capacitors made up of matching dielectric substrate strips C1, C2, C3 respectively are connected to one ends S1, S2, S3 of central conductors L1, L2, L3 respectively and the other ends of the respective matching capacitors are connected to a plane conductor P2. Furthermore, a termination resistor R1 is connected to the one end S3 of the central conductor L3 and the other end of the termination resistor R1 is electrically grounded. A terminal T1 at one end of a variable matching mechanism V1 is further connected to the plane conductor P2 and a terminal T3 of the other end is electrically grounded. The configuration of the variable matching mechanism V1 is the same as the one explained in the first embodiment.

In the case of such a configuration, reactance between the terminals T1, T3 can be changed by turning ON/OFF the switch of the variable matching mechanism V1 and the matching condition of the isolator can be switched to a plurality of states. Therefore, it is possible to obtain a sufficient irreversible characteristic in a plurality of frequency bands using the isolator as a single unit.

Furthermore, in the configuration of the isolator of this embodiment, the variable matching mechanism V1 is connected in series to the respective matching capacitors composed of the matching dielectric substrate strips C1, C2, C3 respectively and the other end of the variable matching mechanism V1 is electrically grounded. Therefore, the number of parts can be reduced compared to the configuration with variable matching mechanisms separately added to the input/output ports of the respective central conductors.

Furthermore, since the configuration of connecting the variable matching mechanism V1 in series to the matching capacitor is adopted, it is possible, when viewed from each input/output port, to increase the amount of displacement of the matching condition with respect to the displacement of reactance of the variable matching mechanism V1 compared to the case where the variable matching mechanism V1 is connected in series to the end of connection S4 and in parallel to the matching capacitor (e.g., FIG. 3). As a result, in this embodiment, the variable width of the operating frequency band can be increased compared to the case where a variable matching mechanism is connected in series to the end of connection S4 and in parallel to the matching capacitor.

Third Embodiment

Next, a third embodiment of the present invention will be explained. This embodiment is an example of Claims 7 to 9.

Figure 9:
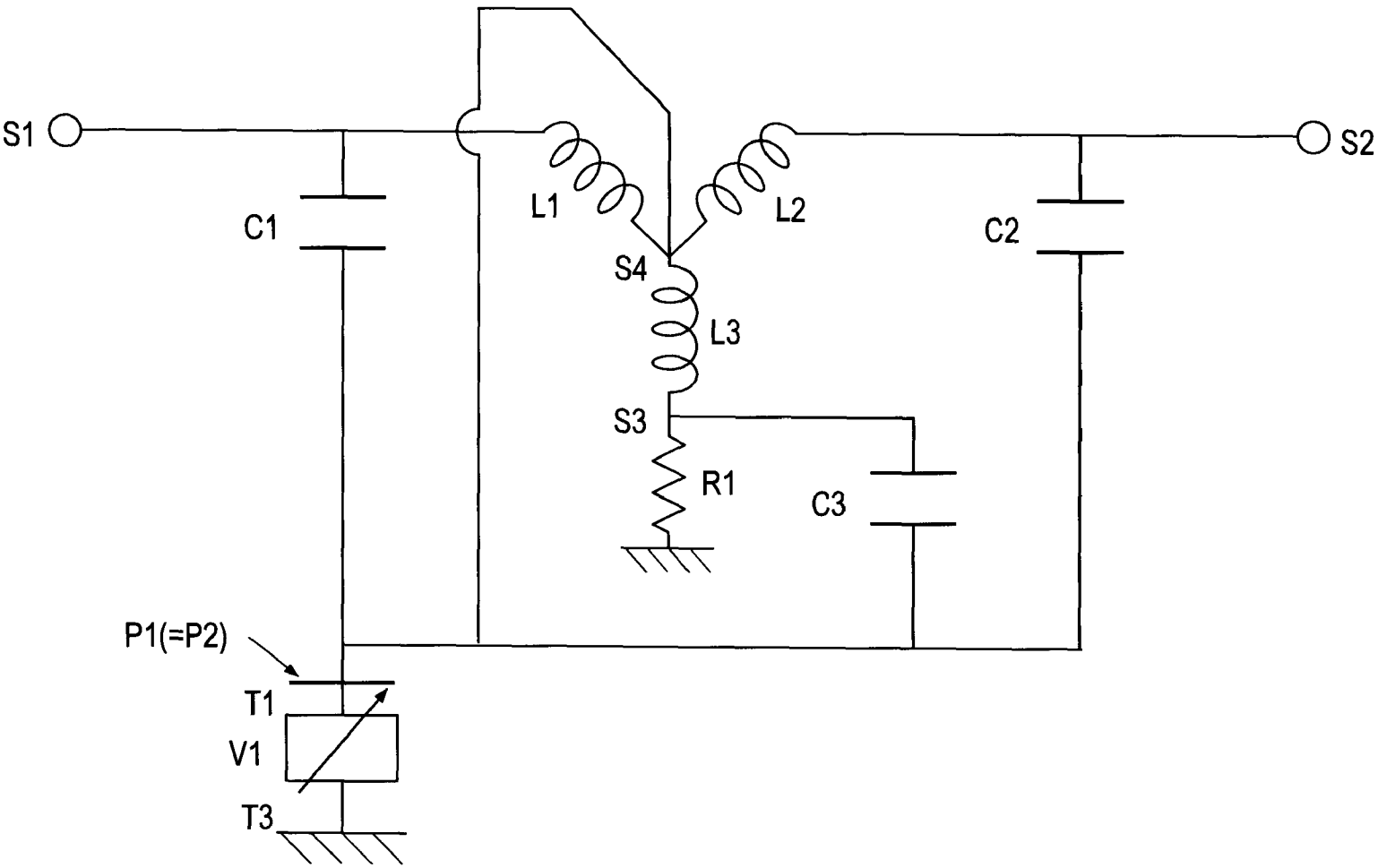
FIG. 9 is an equivalent circuit diagram of an isolator according to a third embodiment.

FIG. 9 is an equivalent circuit diagram of an isolator of this embodiment. As in the case of FIG. 3, descriptions of a ferrite plate and a DC voltage source to drive a variable matching mechanism V1 are omitted in FIG. 9.

As illustrated in FIG. 9, in the isolator of this embodiment, the other ends of one ends S1, S2, S3 of three central conductors L1, L2, L3 are interconnected and the end of connection S4 is connected to a plane conductor P1. The plane conductor P1 of this embodiment is integrated with a plane conductor P2.

Matching capacitors composed of matching dielectric substrate strips C1, C2, C3 respectively are connected to one ends S1, S2, S3 of central conductors L1, L2, L3 respectively and the other ends of the respective matching capacitors are connected to the plane conductor P1 (=P2). Furthermore, a termination resistor R1 is connected to the one end S3 of the central conductor L3 and the other end of the termination resistor R1 is electrically grounded. The plane conductor P1 (=P2) is further connected to a terminal T1 at one end of a variable matching mechanism V1 and a terminal T3 of the other end is electrically grounded. The configuration of the variable matching mechanism V1 is the same as the one explained in the first embodiment.

In the case of such a configuration, it is also possible to change reactance between the terminals T1, T3 by turning ON/OFF the switch of the variable matching mechanism V1 and switch the matching condition of the isolator to a plurality of states. In this way, a sufficient irreversible characteristic can be obtained in a plurality of frequency bands using the isolator as a single unit.

In the configuration of the isolator of this embodiment, the variable matching mechanism V1 is connected in series to the respective matching capacitors made up of the matching dielectric substrate strips C1, C2, C3 respectively and the other end of the variable matching mechanism V1 is electrically grounded. Therefore, the number of parts can be reduced compared to the configuration in which capacitors are separately added to the input/output ports of the respective central conductors.

Furthermore, since the configuration of connecting the variable matching mechanism V1 in series to the matching capacitor is adopted, the amount of displacement of the matching condition with respect to the displacement of reactance of the variable matching mechanism V1 can be increased compared to the case where the variable matching mechanism V1 is connected in series to the end of connection S4 and in parallel to the matching capacitor. As a result, this embodiment can, when viewed from each input/output port, drastically increase the variable width of the operating frequency band compared to the case where the variable matching mechanism V1 is connected in series to the end of connection S4 and in parallel to the matching capacitor.

Furthermore, since the isolator of this embodiment adopts a configuration where the plane conductors P1 and P2 are united, it also has an advantage of being able to reduce the number of parts and the number of man-hours. However, it is also possible to adopt a configuration in which different members are used for the plane conductors P1 and P2 and these conductors are then connected.

Fourth Embodiment

Next, a fourth embodiment of the present invention will be explained. This embodiment is an example of Claims 10 to 12.

Figure 10:
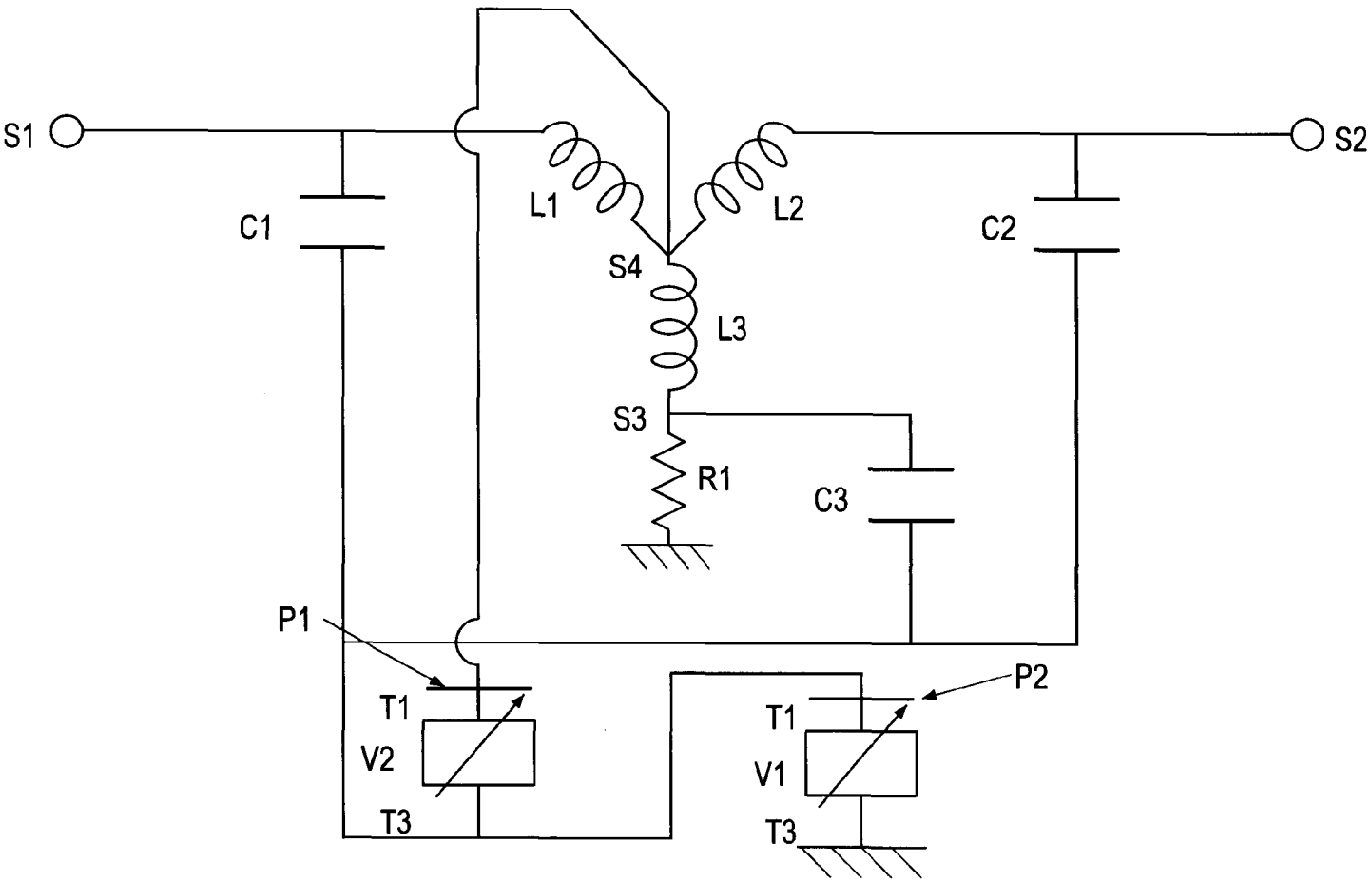
FIG. 10 is an equivalent circuit diagram of an isolator according to a fourth embodiment.

FIG. 10 is an equivalent circuit diagram of the isolator of this embodiment. As in the case of FIG. 3, descriptions of a ferrite plate and a DC voltage source to drive variable matching mechanisms V1, V2 are omitted in FIG. 10.

As illustrated in FIG. 10, in the isolator of this embodiment, the other ends of one ends S1, S2, S3 of three central conductors L1, L2, L3 are interconnected and the end of connection S4 is connected to a plane conductor P1. A terminal T1 at one end of the variable matching mechanism V2 is connected in series to the plane conductor P1 and a terminal T3 at the other end is connected to a plane conductor P2. The configuration of the variable matching mechanism V2 is the same as that of the variable matching mechanism V1 explained in the first embodiment.

Matching capacitors composed of matching dielectric substrate strips C1, C2, C3 respectively are connected to one ends S1, S2, S3 of central conductors L1, L2, L3 respectively and the other ends of the respective matching capacitors are connected to the plane conductor P2. Furthermore, a termination resistor R1 is connected to the one end S3 of the central conductor L3 and the other end of the termination resistor R1 is electrically grounded. A terminal T1 at one end of the variable matching mechanism V1 is connected to the plane conductor P2 and a terminal T3 at the other end is electrically grounded. The configuration of the variable matching mechanism V1 is the same as the one explained in the first embodiment.

In the case of such a configuration, it is also possible to change reactance between the terminals T1, T3 by turning ON/OFF the switches of the variable matching mechanisms V1, V2 and switch the matching condition of the isolator to a plurality of states. In this way, a sufficient irreversible characteristic can be obtained in a plurality of frequency bands using the isolator as a single unit.

Especially this embodiment provides, when viewed from each input/output port, the variable matching mechanism V2 connected in series to the end of connection S4 of the central conductors L1, L2, L3 and in parallel to each matching capacitor and the variable matching mechanism V1 connected in series to the variable matching mechanism V2 and each matching capacitor, and can thereby make a switchover to more operating frequency bands than the configuration having only one variable matching mechanism. Furthermore, in the case of the configuration of this embodiment, even when the variable matching mechanism V1 and the matching mechanism V2 have completely the same configuration, this configuration allows a switchover to be made to more operating frequency bands than the configuration having only one variable matching mechanism. Achieving such commonality in parts brings about advantageous effects such as a reduction of parts cost and a reduction of parts management cost.

Furthermore, since the configuration of connecting the variable matching mechanisms in series to the matching capacitor is adopted, the amount of displacement of the matching condition with respect to the displacement of reactance of the variable matching mechanisms can be increased compared to the case where the variable matching mechanisms are connected in series to the end of connection S4 and in parallel to the matching capacitor. As a result, this embodiment can increase the variable width of the operating frequency band compared to the case where the variable matching mechanisms are connected in series to the end of connection S4 and in parallel to the matching capacitor.

Furthermore, though the configuration of the isolator of this embodiment includes two variable matching mechanisms V1, V2, it is possible to reduce the number of parts compared to the configuration in which variable matching mechanisms are separately added to the input/output ports of the respective central conductors. The isolator of this embodiment can increase the number of switchable operating frequency bands more than that in Patent literature 1 while reducing the number of parts more than that in [Fifth embodiment]

Next, a fifth embodiment of the present invention will be explained. This embodiment is an example of Claims 13 to 15.

Figure 11:
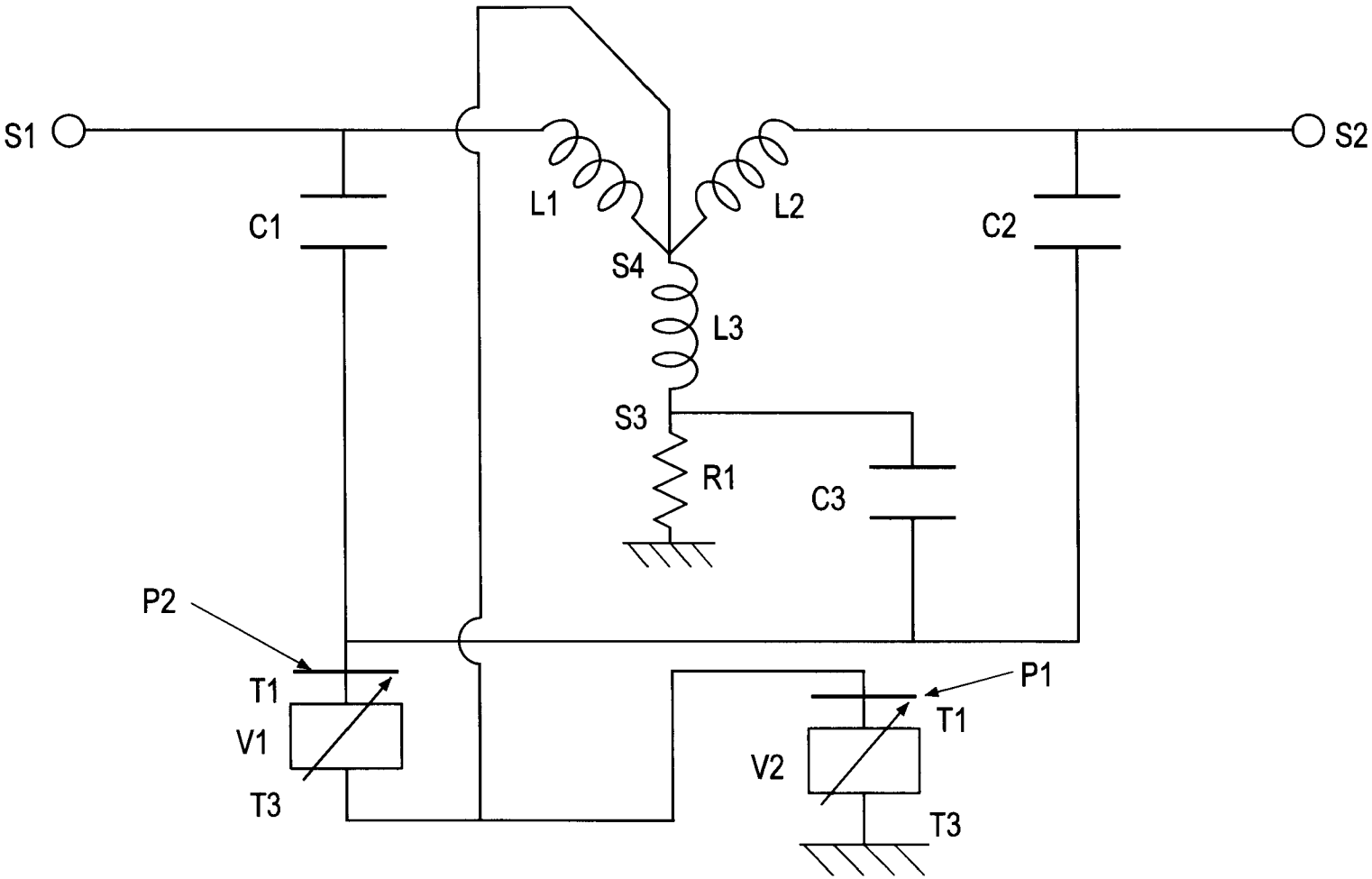
FIG. 11 is an equivalent circuit diagram of an isolator according to a fifth embodiment.

FIG. 11 is an equivalent circuit diagram of an isolator of this embodiment. As in the case of FIG. 3, descriptions of a ferrite plate and a DC voltage source to drive variable matching mechanisms V1, V2 are omitted in FIG. 11.

As illustrated in FIG. 11, in the isolator of this embodiment, the other ends of one ends S1, S2, S3 of three central conductors L1, L2, L3 are interconnected and an end of connection S4 is connected to a plane conductor P1. A terminal T1 at one end of the variable matching mechanism V2 is further connected in series to the plane conductor P1 and a terminal T3 at the other end is electrically grounded. The configuration of the variable matching mechanism V2 is the same as that of the variable matching mechanism V1 explained in the first embodiment.

Matching capacitors composed of matching dielectric substrate strips C1, C2, C3 respectively are connected to one ends S1, S2, S3 of the central conductors L1, L2, L3 respectively and the other end of each matching capacitor is connected to the plane conductor P2. Furthermore, a termination resistor R1 is connected to the one end S3 of the central conductor L3 and the other end of the termination resistor R1 is electrically grounded.

A terminal T1 at one end of the variable matching mechanism V1 is connected to the plane conductor P2 and a terminal T3 at the other end is connected to the plane conductor P1. The configuration of the variable matching mechanism V1 is the same as the one explained in the first embodiment.

Such a configuration also exerts advantageous effects as shown in the fourth embodiment. Especially this embodiment adopts a configuration in which, when viewed from each input/output port, the variable matching mechanism V1 and the variable matching mechanism V2 are connected in series to each matching capacitor and the variable matching mechanism V2 is connected in series to the end of connection S4 of the central conductors L1, L2, L3, and can thereby make a switchover to more operating frequency bands than the configuration having only one variable matching mechanism.

Furthermore, since the configuration of connecting the variable matching mechanisms V1, V2 in series to the matching capacitor is adopted, it is possible to increase the amount of displacement of matching conditions with respect to the displacement of the reactance of the variable matching mechanisms V1, V2. As a result, this embodiment allows the variable width of the operating frequency band to be increased.

Sixth Embodiment

Next, a sixth embodiment of the present invention will be explained. This embodiment is an example of Claims 16 to 18.

Figure 12:
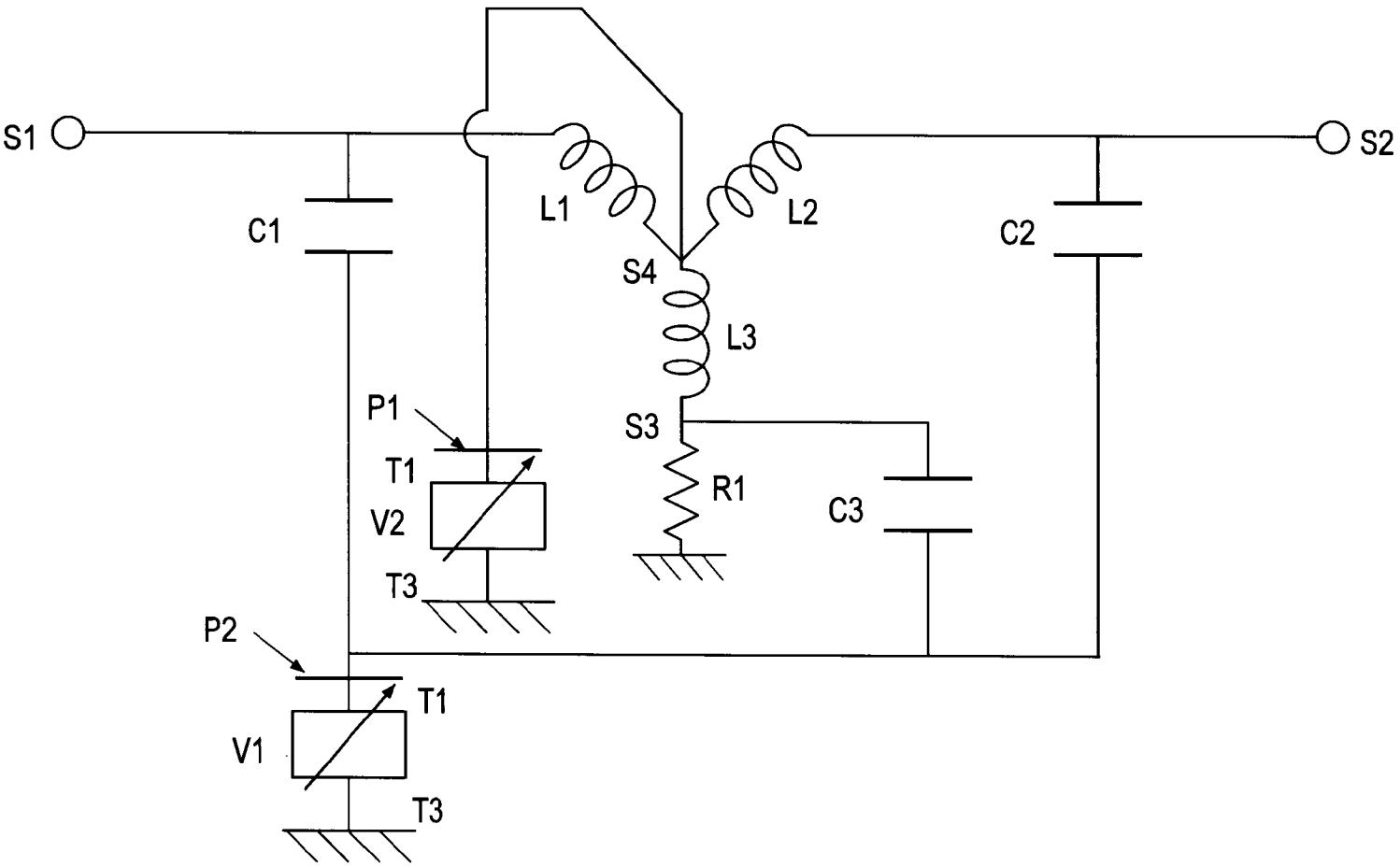
FIG. 12 is an equivalent circuit diagram of an isolator according to a sixth embodiment.

FIG. 12 is an equivalent circuit diagram of an isolator of this embodiment. As in the case of FIG. 3, descriptions of a ferrite plate and a DC voltage source to drive variable matching mechanisms V1, V2 are omitted in FIG. 12.

As illustrated in FIG. 12, in the isolator of this embodiment, the other ends of one ends S1, S2, S3 of three central conductors L1, L2, L3 are interconnected and the end of connection S4 is connected to a plane conductor P1. A terminal T1 at one end of the variable matching mechanism V2 is further connected in series to the plane conductor P1 and a terminal T3 at the other end is electrically grounded. The configuration of the variable matching mechanism V2 is the same as that of the variable matching mechanism V1 explained in the first embodiment.

Matching capacitors composed of matching dielectric substrate strips C1, C2, C3 respectively are connected to one ends S1, S2, S3 of the central conductors L1, L2, L3 respectively and the other end of each matching capacitor is connected to the plane conductor P2. Furthermore, a termination resistor R1 is connected to the one end S3 of the central conductor L3 and the other end of the termination resistor R1 is electrically grounded.

A terminal T1 at one end of the variable matching mechanism V1 is connected to the plane conductor P2 and a terminal T3 at the other end is electrically grounded. The configuration of the variable matching mechanism V1 is the same as the one explained in the first embodiment.

Such a configuration also exerts advantageous effects as shown in the fourth embodiment. Especially this embodiment connects, when viewed from each input/output port, the variable matching mechanism V1 in series to each matching capacitor and connects the variable matching mechanism V2 in series to the end of connection S4 of the central conductors L1, L2, L3 and electrically grounds the other end of each variable matching mechanism, and can thereby make a switchover to more operating frequency bands than the configuration having only one variable matching mechanism.

Furthermore, since the configuration of connecting the variable matching mechanism V1 in series to the matching capacitor is adopted, the amount of displacement of matching conditions with respect to the displacement of reactance of the variable matching mechanism V1 can be increased compared to the case where the variable matching mechanism V1 is connected in parallel to the matching capacitor. As a result, this embodiment allows the variable width of the operating frequency band to be increased compared to the case where the variable matching mechanism V1 is connected in parallel to the matching capacitor.

Seventh Embodiment

Next, a seventh embodiment of the present invention will be explained. This embodiment is an example of Claim 31.

Figure 13:
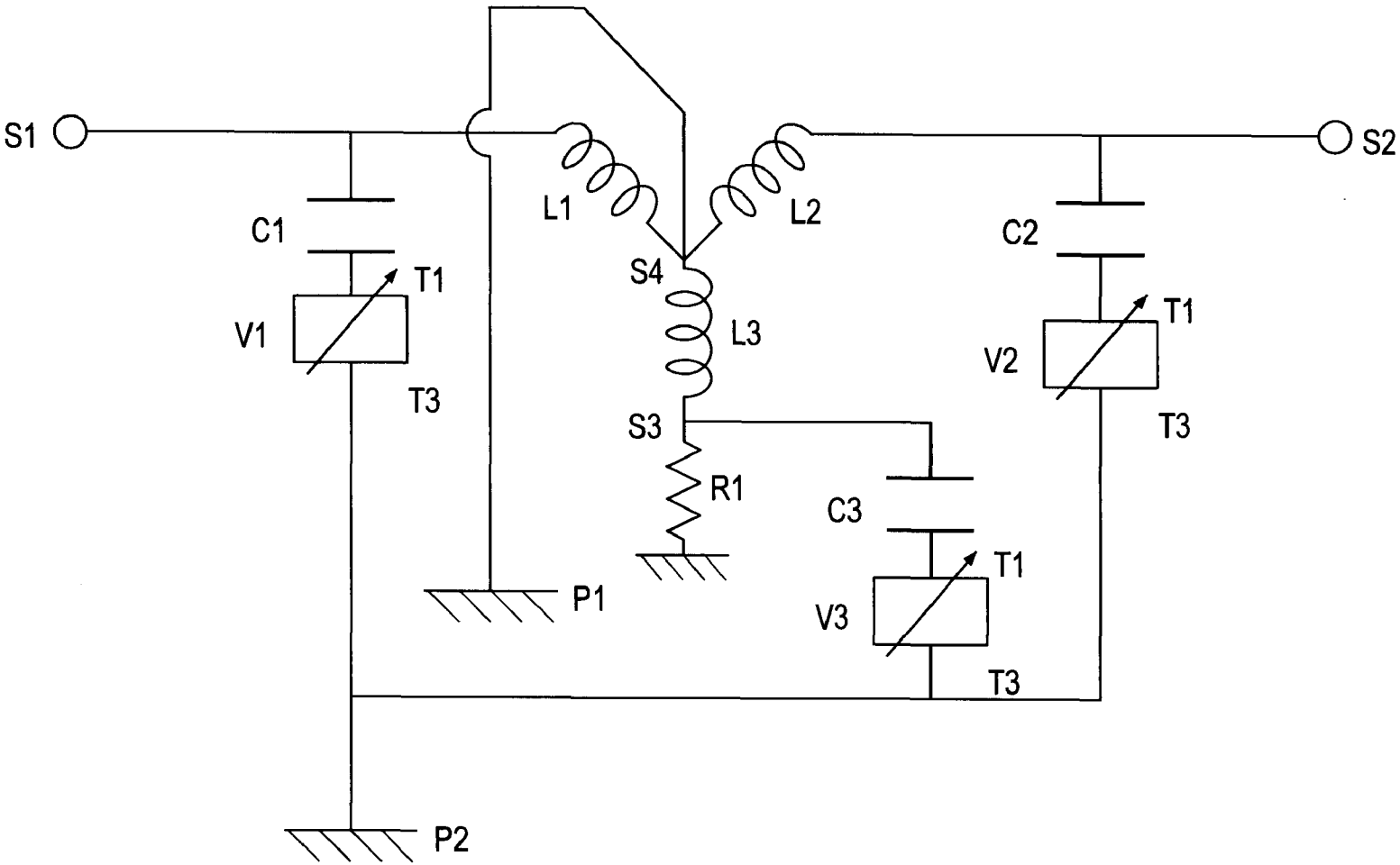
FIG. 13 is an equivalent circuit diagram of an isolator according to a seventh embodiment.

FIG. 13 is an equivalent circuit diagram of an isolator of this embodiment. As in the case of FIG. 3, descriptions of a ferrite plate and a DC voltage source to drive variable matching mechanisms V1, V2, V3 are omitted in FIG. 13.

As illustrated in FIG. 13, in the isolator of this embodiment, the other ends of one ends S1, S2, S3 of three central conductors L1, L2, L3 are interconnected and the end of connection S4 is connected to a plane conductor P1 which is electrically grounded.

Matching capacitors composed of matching dielectric substrate strips C1, C2, C3 respectively are connected to one ends S1, S2, S3 of the central conductors L1, L2, L3 respectively. Each terminal T1 of the variable matching mechanisms V1, V2, V3 is connected in series to the other end of each matching capacitor and each terminal T3 of the other end of each of the variable matching mechanisms V1, V2, V3 is connected to a plane conductor P2 which is electrically grounded. Furthermore, a termination resistor R1 is connected to the one end S3 of the central conductor L3 and the other end of the termination resistor R1 is electrically grounded. The configuration of the variable matching mechanisms V1, V2, V3 is same as that of the variable matching mechanism V1 explained in the first embodiment and the variable matching mechanisms V1, V2, V3 have a configuration identical to each other.

In the case of such a configuration, it is also possible to change reactance between the terminals T1, T3 by turning ON/OFF the switches of the variable matching mechanisms V1, V2, V3 and switch the matching condition of the isolator to a plurality of states. Therefore, a sufficient irreversible characteristic can be obtained using the isolator as a single unit in a plurality of frequency bands.

Furthermore, since the configuration of connecting the variable matching mechanisms V1, V2, V3 in series to the respective matching capacitors is adopted, it is possible, when viewed from each input/output port, to increase the amount of displacement of matching conditions with respect to the displacement of reactance of the variable matching mechanisms V1, V2, V3 compared to the case where the variable matching mechanism is connected in series to the end of connection S4 and in parallel to the matching capacitor. As a result, this embodiment allows the variable width of the operating frequency band to be increased compared to the case where the variable matching mechanism is connected in series to the end of connection S4 and in parallel to the matching capacitor.

Eighth Embodiment

Next, an eighth embodiment of the present invention will be explained. In this embodiment, a grounding capacitor is mounted in the configuration of the third embodiment shown in FIG. 9. This embodiment is an example of Claims 19 to 21.

Figure 14:
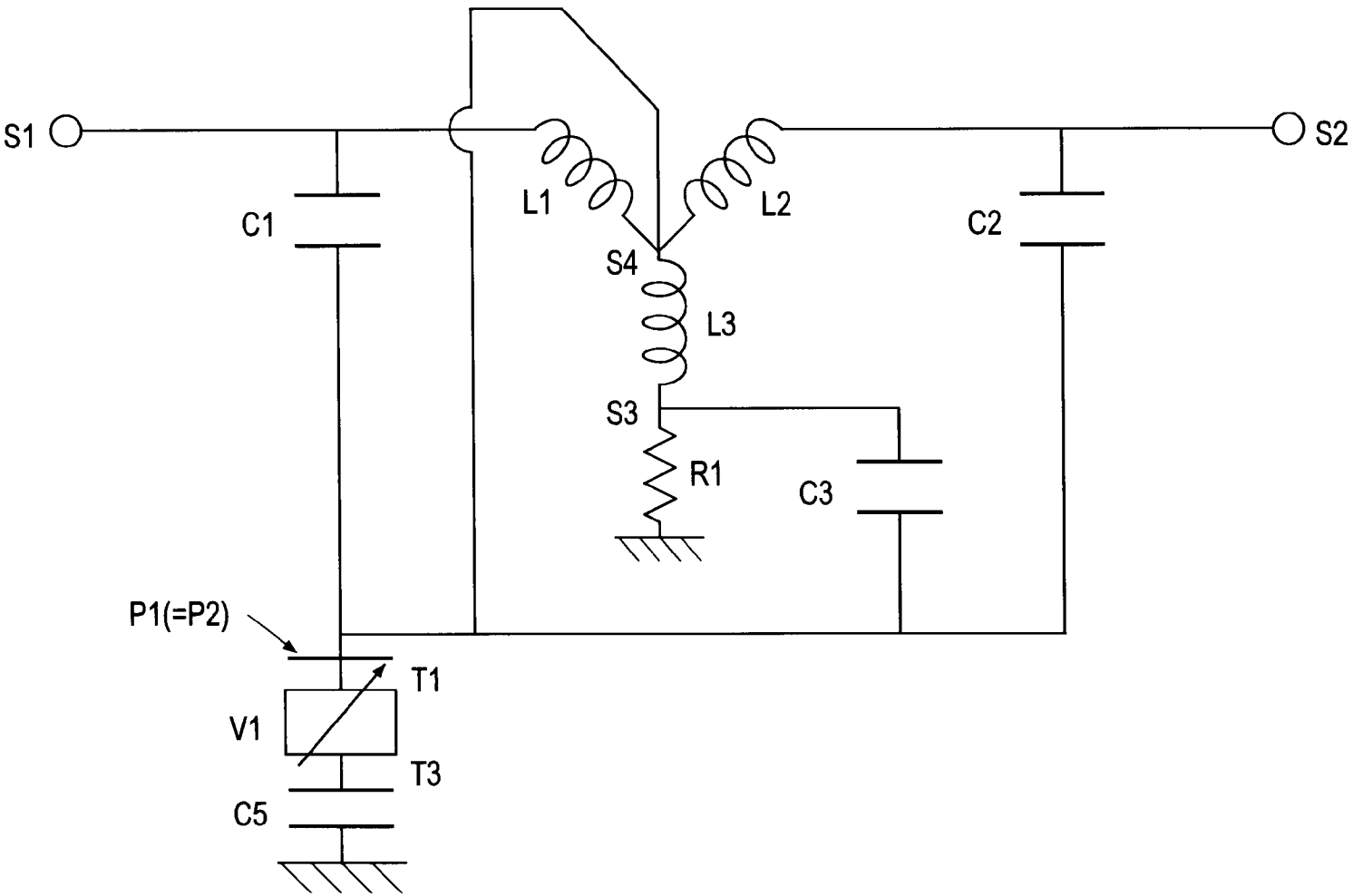
FIG. 14 is an equivalent circuit diagram of an isolator according to an eighth embodiment.

FIG. 14 is an equivalent circuit diagram of an isolator of this embodiment. As in the case of FIG. 9, descriptions of a ferrite plate and a DC voltage source to drive a variable matching mechanism V1 are omitted in FIG. 14.

In the isolator according to the third embodiment, the plane conductor P1 (=P2) is connected to the terminal T1 at one end of the variable matching mechanism V1 and the terminal T3 at the other end is electrically grounded (FIG. 9), but as illustrated in FIG. 14, in the isolator of this embodiment, a plane conductor P1 (=P2) is connected to a terminal T1 at one end of a variable matching mechanism V1, a terminal T3 at the other end is connected in series to a grounding capacitor C5 and the other end of the grounding capacitor C5 is electrically grounded.

When the grounding capacitor C5 is mounted in this way, passage loss is reduced compared to the configuration in which the grounding capacitor C5 is not mounted.

Ninth Embodiment

Next, a ninth embodiment of the present invention will be explained. In this embodiment, a grounding capacitor is mounted in the configuration of the fourth embodiment shown in FIG. 10. This embodiment is an example of Claims 22 to 24.

Figure 15:
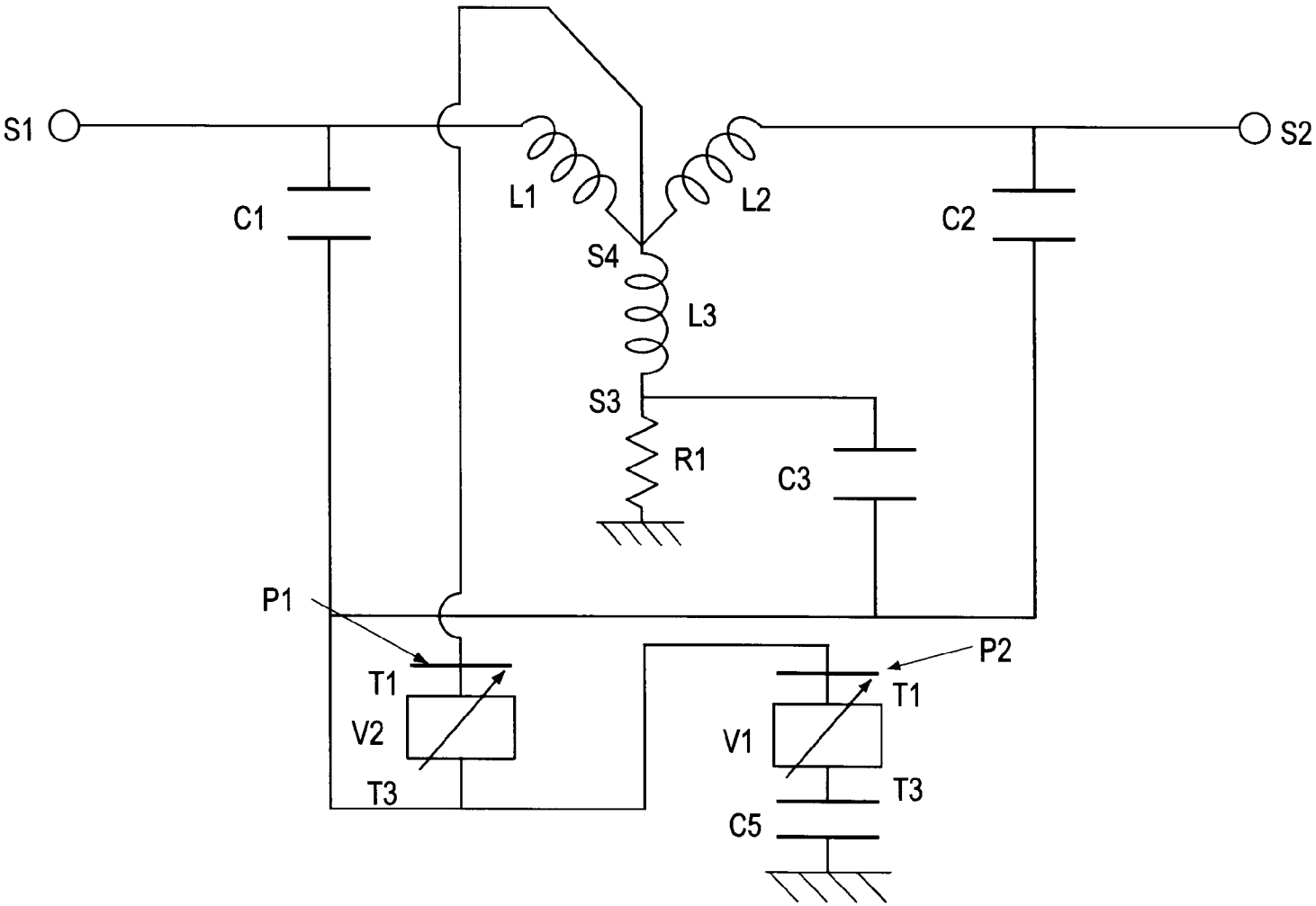
FIG. 15 is an equivalent circuit diagram of an isolator according to a ninth embodiment.

FIG. 15 is an equivalent circuit diagram of an isolator of this embodiment. As in the case of FIG. 10, descriptions of a ferrite plate and a DC voltage source to drive variable matching mechanisms V1, V2 are omitted in FIG. 15.

In the isolator according to the fourth embodiment, the plane conductor P2 is connected to the terminal T1 at one end of the variable matching mechanism V1 and the terminal T3 at the other end is electrically grounded (FIG. 10), but as illustrated in FIG. 15, in the isolator of this embodiment, a plane conductor P2 is connected to a terminal T1 at one end of a variable matching mechanism V2, a terminal T3 at the other end is connected in series to a grounding capacitor C5 and the other end of the grounding capacitor C5 is electrically grounded.

When the grounding capacitor C5 is mounted in this way, passage loss is reduced compared to the configuration in which the grounding capacitor C5 is not mounted.

Tenth Embodiment

Next, a tenth embodiment of the present invention will be explained. In this embodiment, a grounding capacitor is mounted in the configuration of the fifth embodiment shown in FIG. 11. This embodiment is an example of Claims 25 to 27.

Figure 16:
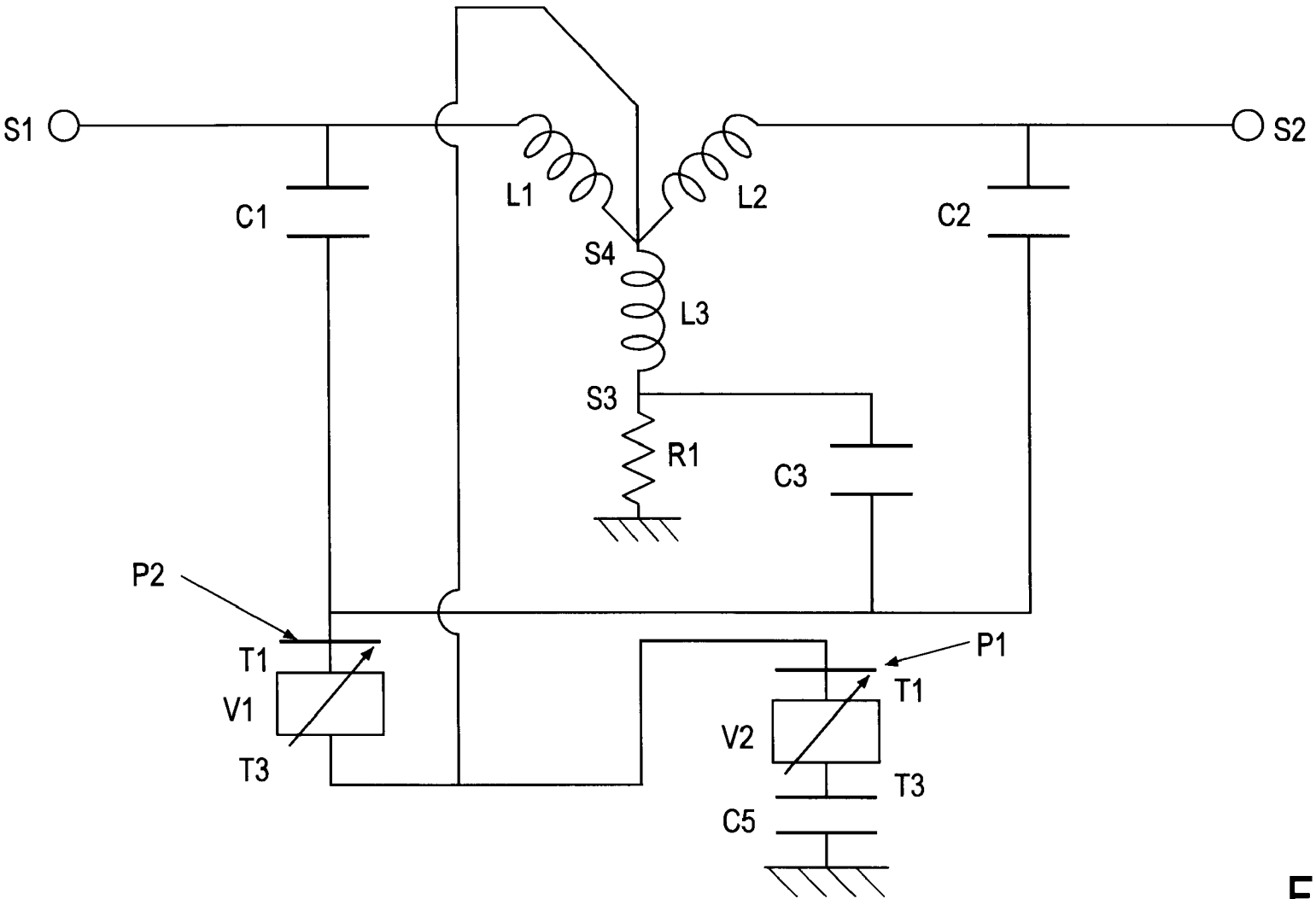
FIG. 16 is an equivalent circuit diagram of an isolator according to a tenth embodiment.

FIG. 16 is an equivalent circuit diagram of an isolator of this embodiment. As in the case of FIG. 11, descriptions of a ferrite plate and a DC voltage source to drive variable matching mechanisms V1, V2 are omitted in FIG. 16.

In the isolator according to the fifth embodiment, the plane conductor P1 is connected to the terminal T1 at one end of the variable matching mechanism V2 and the terminal T3 at the other end is electrically grounded (FIG. 11), but as illustrated in FIG. 16, in the isolator of this embodiment, a plane conductor P1 is connected to a terminal T1 at one end of a variable matching mechanism V1, a terminal T3 at the other end is connected in series to a grounding capacitor C5 and the other end of the grounding capacitor C5 is electrically grounded.

When the grounding capacitor C5 is mounted in this way, passage loss is reduced compared to the configuration in which the grounding capacitor C5 is not mounted.

Eleventh Embodiment

Next, an eleventh embodiment of the present invention will be explained. In this embodiment, a grounding capacitor is mounted in the configuration of the sixth embodiment shown in FIG. 12. This embodiment is an example of Claims 28 to 30.

Figure 17:
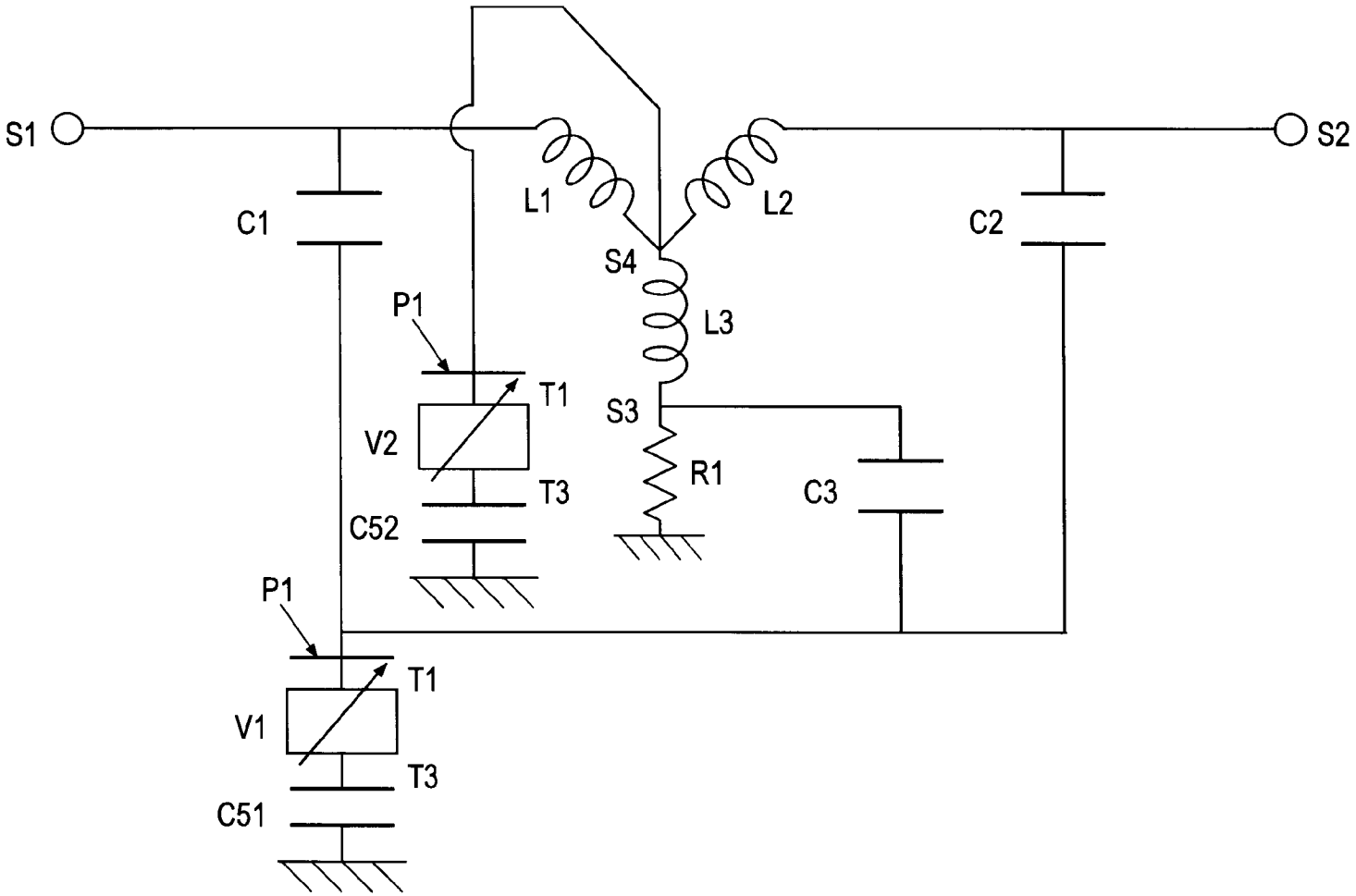
FIG. 17 is an equivalent circuit diagram of an isolator according to an eleventh embodiment.

FIG. 17 is an equivalent circuit diagram of an isolator of this embodiment. As in the case of FIG. 12, descriptions of a ferrite plate and a DC voltage source to drive variable matching mechanisms V1, V2 are omitted in FIG. 17.

In the isolator according to the sixth embodiment, the plane conductor P1 is connected to the terminal T1 at one end of the variable matching mechanism V2 and the terminal T3 at the other end is electrically grounded, the plane conductor P2 is connected to the terminal T1 at the one end of the variable matching mechanism V1 and the terminal T3 at the other end is electrically grounded (FIG. 12). But as illustrated in FIG. 17, in the isolator of this embodiment, a plane conductor P1 is connected to a terminal T1 at one end of a variable matching mechanism V2, a terminal T3 at the other end is connected in series to a grounding capacitor C52 and the other end of the grounding capacitor C52 is electrically grounded, a plane conductor P2 is connected to a terminal T1 at one end of a variable matching mechanism V1, a terminal T3 at the other end is connected in series to a grounding capacitor C51 and the other end of the grounding capacitor C51 is electrically grounded.

When the grounding capacitors C51, C52 are mounted in this way, passage loss is reduced compared to the configuration in which the grounding capacitors C51, C52 are not mounted.

Twelfth Embodiment

Next, a twelfth embodiment of the present invention will be explained. In this embodiment, a grounding capacitor is mounted in the configuration of the first embodiment shown in FIG. 3. This embodiment is an example of Claim 33.

Figure 18:
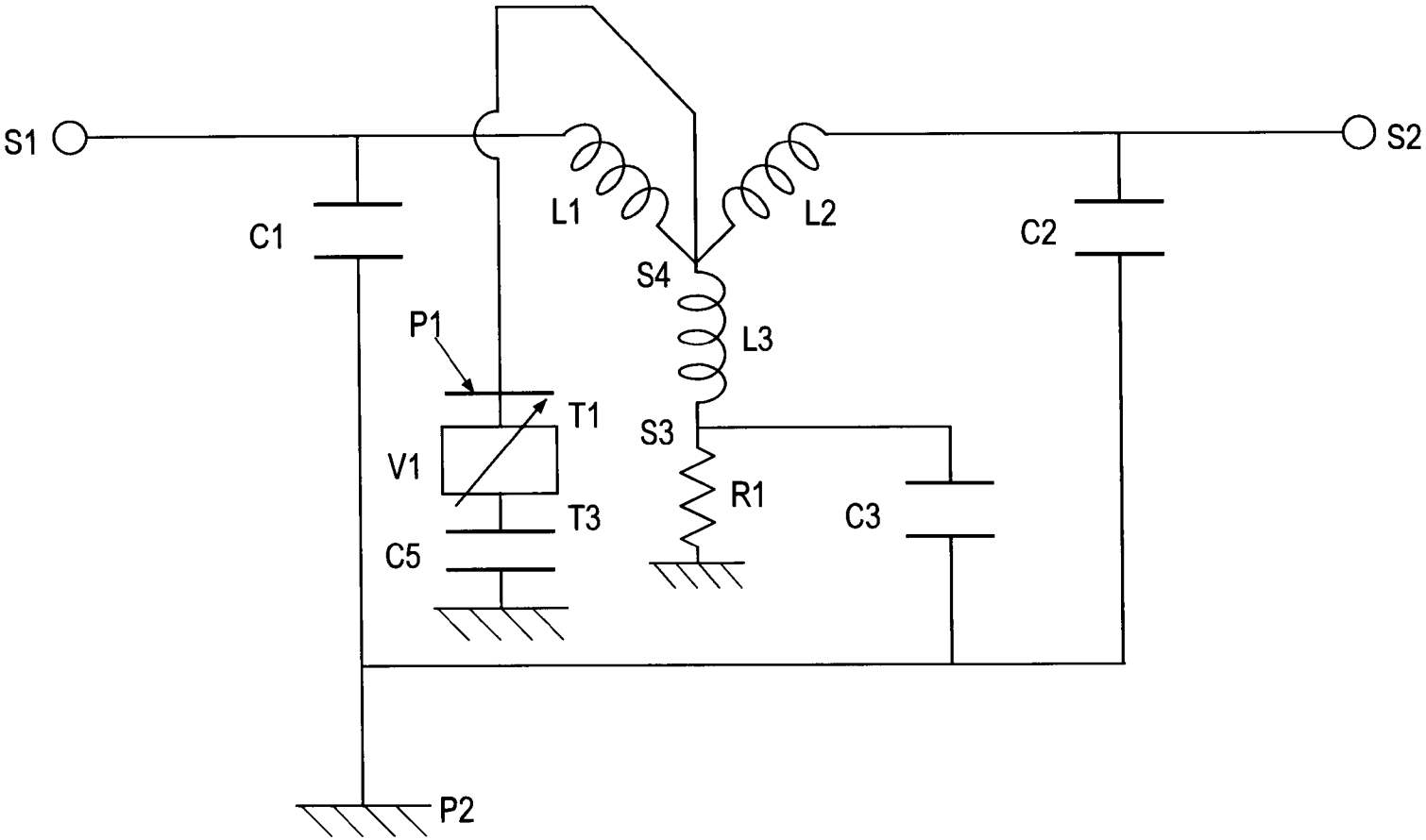
FIG. 18 is an equivalent circuit diagram of an isolator according to a twelfth embodiment.

FIG. 18 is an equivalent circuit diagram of an isolator of this embodiment. As in the case of FIG. 3, descriptions of a ferrite plate and a DC voltage source to drive a variable matching mechanism V1 are omitted in FIG. 18.

In the isolator according to the first embodiment, the plane conductor P1 is connected to the terminal T1 at one end of the variable matching mechanism V1 and the terminal T3 at the other end is electrically grounded (FIG. 3), but as illustrated in FIG. 18, in the isolator of this embodiment, a plane conductor P1 is connected to a terminal T1 at one end of a variable matching mechanism V1, a terminal T3 at the other end is connected in series to a grounding capacitor C5 and the other end of the grounding capacitor C5 is electrically grounded.

When the grounding capacitor C5 is mounted in this way, passage loss is reduced compared to the configuration in which the grounding capacitor C5 is not mounted.

Thirteenth Embodiment

In this embodiment, a capacitor incorporated in a variable matching mechanism is also used as a grounding capacitor and caused to display performance equivalent to or higher than that of the eighth to twelfth embodiments. This embodiment is an example of Claims 38 to 40.

As such a variable matching mechanism, a circuit is used which includes one or more series circuits made up of a first circuit element having predetermined reactance and a switch connected in series thereto and a second circuit element having predetermined reactance are connected in parallel to each other, in which turning ON/OFF the switch changes reactance between one end of connection between the series circuits and the second circuit element and the other end of connection and the first circuit element and the second circuit element each have a capacitor on the side closest to a grounded terminal T3 at the other end of the variable matching mechanism. As a specific example thereof, one illustrated in FIG. 5 is used.

Furthermore, such a variable matching mechanism is used for all the variable matching mechanisms V1, V2 in FIG. 12 (example of Claim 38), for the variable matching mechanism V1 in FIG. 3, FIG. 9, FIG. 10 (example of Claim 39) or for the variable matching mechanism V2 in FIG. 11 (example of Claim 40). This allows the capacitor incorporated in the variable matching mechanism (e.g., C41, C42, C43 in the example of FIG. 5) to be used as the grounding capacitor and can reduce passage loss of the isolator.

When a grounding capacitor is externally added to the variable matching mechanism as in the cases of the eighth to twelfth embodiments, it goes without saying that the capacitance of the grounding capacitor does not change even if reactance of the variable matching mechanism is changed. However, when the capacitor incorporated in the variable matching mechanism is used as the grounding capacitor as in this embodiment, it is possible to perform switching control over reactance including the reactance component of the grounding capacitor. Therefore, it is possible to take large switching displacement of the operating frequency band and also optimize passage loss for each operating frequency band.

Fourteenth Embodiment

As the variable matching mechanism, this embodiment uses a circuit including a variable capacitor whose capacitance is variable, in which reactance between one end of the variable capacitor and the other end thereof can be changed by changing the capacitance of the variable capacitor (example in Claim 36). Furthermore, the variable capacitor of this embodiment is a capacitor composed of a first conductor and a second conductor and the capacitance thereof is changed by mechanically changing the distance between the first conductor and the second conductor (example in Claim 37).

Figure 19:
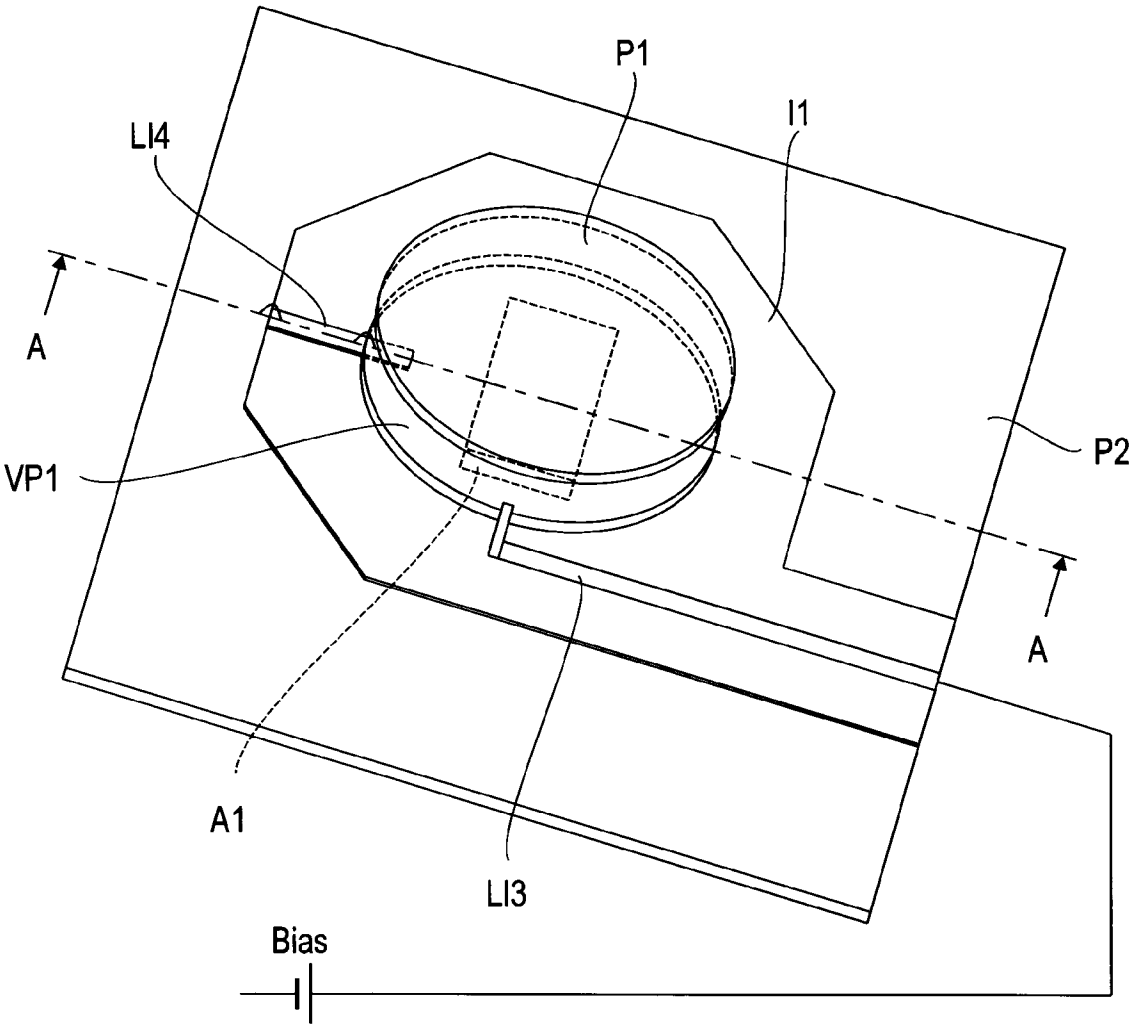
FIG. 19 is a see-through perspective view illustrating the configuration of a variable matching mechanism according to a fourteenth embodiment.
Figure 20:
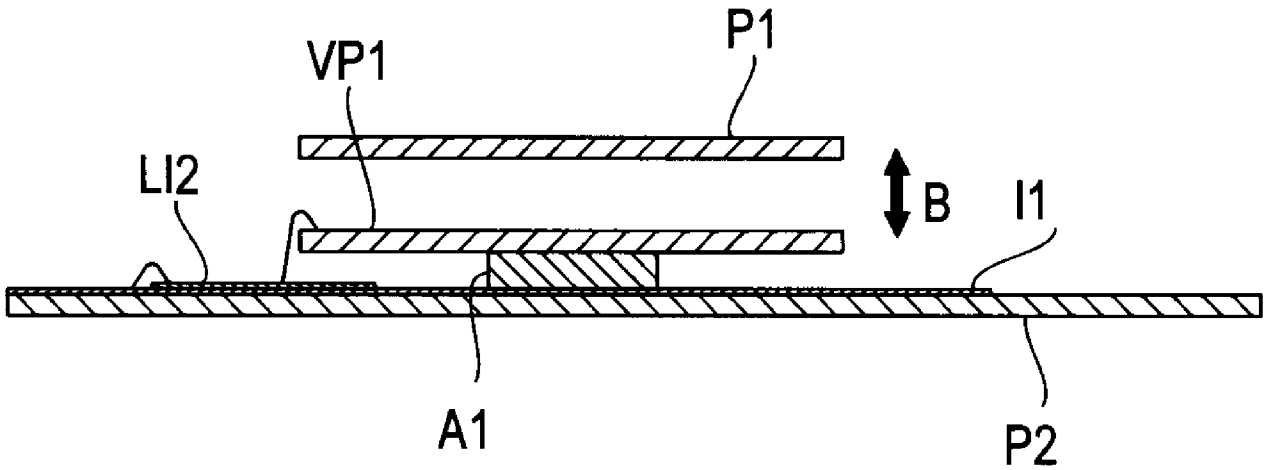
FIG. 20 is an A-A sectional view of FIG. 19.

FIG. 19 is a see-through perspective view illustrating the configuration of the variable matching mechanism of this embodiment and FIG. 20 is an A-A sectional view of FIG. 19.

In this configuration, an insulator film I1 is formed in part of one side (top surface in FIG. 19, FIG. 20) of a plane conductor P2 and linear conductors LI3, LI4 are formed on the surface of the insulator film I1. Furthermore, an actuator A1 is fixed to the surface of the insulator film I1 and a plane conductor VP1 is fixed to the top surface (top surface in FIG. 19, FIG. 20) of the actuator A1. A plane conductor P1 (isomorphic to the plane conductor VP1) is arranged in parallel to the plane conductor VP1 on the top surface side of the plane conductor VP1 (top surface side in FIG. 19, FIG. 20). As described above (FIG. 1 or the like), the plane conductor P1 is configured integral with the central conductors L1, L2, L3 and the central conductors L1, L2, L3 are fixed to the matching dielectric substrate strips C1, C2, C3 fixed to the plane conductor P2. That is, the position of the plane conductor P1 relative to the plane conductor P2 is fixed. Furthermore, one end of the linear conductor LI3 is connected to a DC voltage source (Bias) for driving the actuator and the other end thereof is connected to the drive terminal of the actuator A1. Furthermore, one end of the linear conductor LI4 is connected to the plane conductor P2 through wire bonding or the like, the other end thereof is connected to the plane conductor VP1 so as to make the plane conductor P2 communicate with the plane conductor VP1.

This embodiment uses a variable capacitor which is composed of this plane conductor VP1 and a plane conductor P1 as a variable matching mechanism. That is, the capacitance C of the variable capacitor which is composed of the plane conductor VP1 and plane conductor P1 is determined by C=□·S/d, where it is assumed that the aerial permittivity is □, the area of the plane conductor VP1, P1 is S and the distance between the plane conductor VP1 and P1 is d. Therefore, by driving the actuator A1 and moving the plane conductor VP1 in the direction of B, it is possible to change the distance d between the plane conductors VP1 and P1 and change the capacitance C. Applying the variable matching mechanism configured in this way to, for example, the isolator shown in FIG. 10 makes it possible to change the matching condition of the isolator, too.

Fifteenth Embodiment

This embodiment equalizes all impedances Z1, Z2, Z3 of portions connecting the respective central conductors L1, L2, L3 and a variable matching mechanism V1 (example of Claim 2). This embodiment also equalizes all impedances Z1', Z2', Z3' of portions connecting the respective capacitors C1, C2, C3 and the variable matching mechanism V1 (example of Claim 3).

In the lumped-element type isolator which forms the basis of the present invention, when, for example, a signal is inputted to one end of the central conductor L1 and outputted from one end of the central conductor L2, reflection takes place when the signal is inputted to the central conductor L1 and when the signal is outputted from the central conductor L2 in that process. The smaller the amount of reflection thereof, the lower is the loss with which the signal can be passed and when the frequency characteristic is taken into consideration, the smaller the difference between the frequency at which the amount of reflection when the signal is inputted to L1 becomes a minimum and the frequency at which the amount of reflection when the signal is outputted from L2 becomes a minimum, the lower is the loss with which the signal components of frequencies around those frequencies can be passed.

Figure 30:
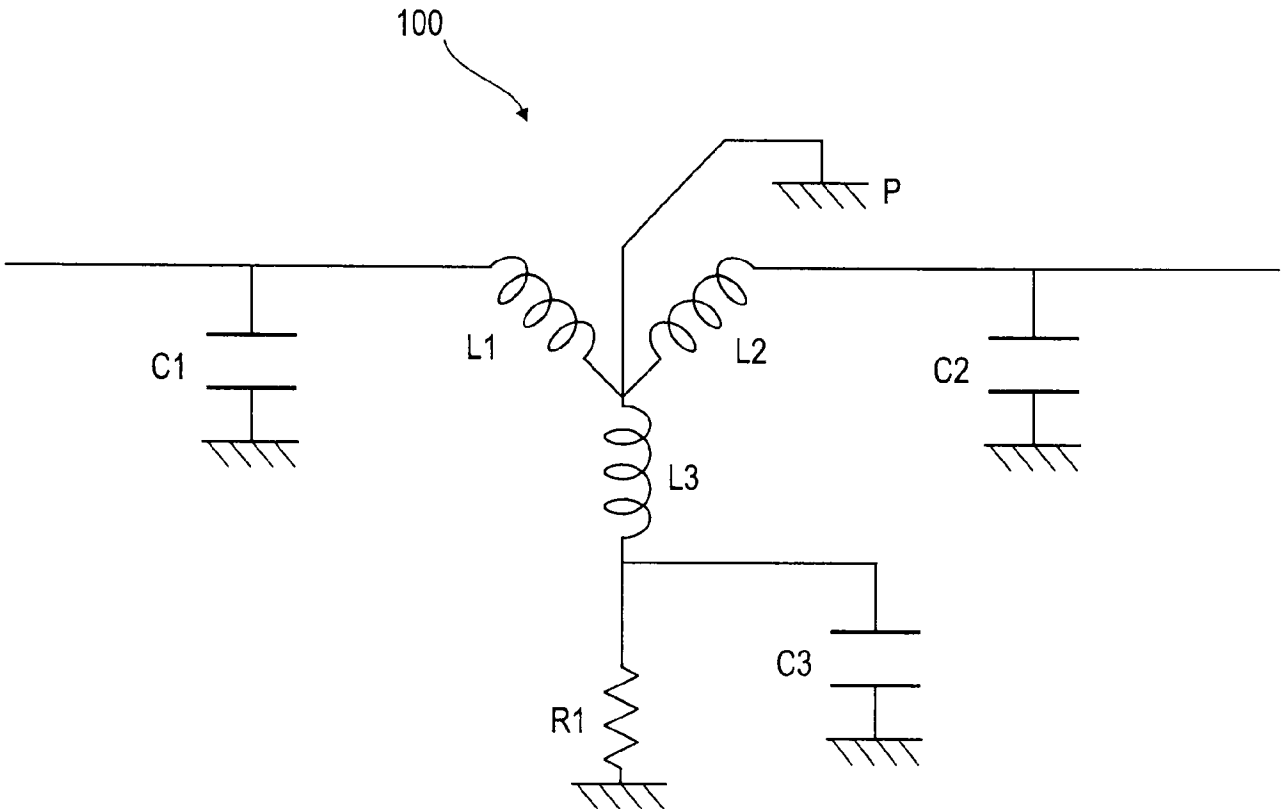
FIG. 30 is a circuit diagram showing the equivalent circuit in FIG. 29.
Figure 31:
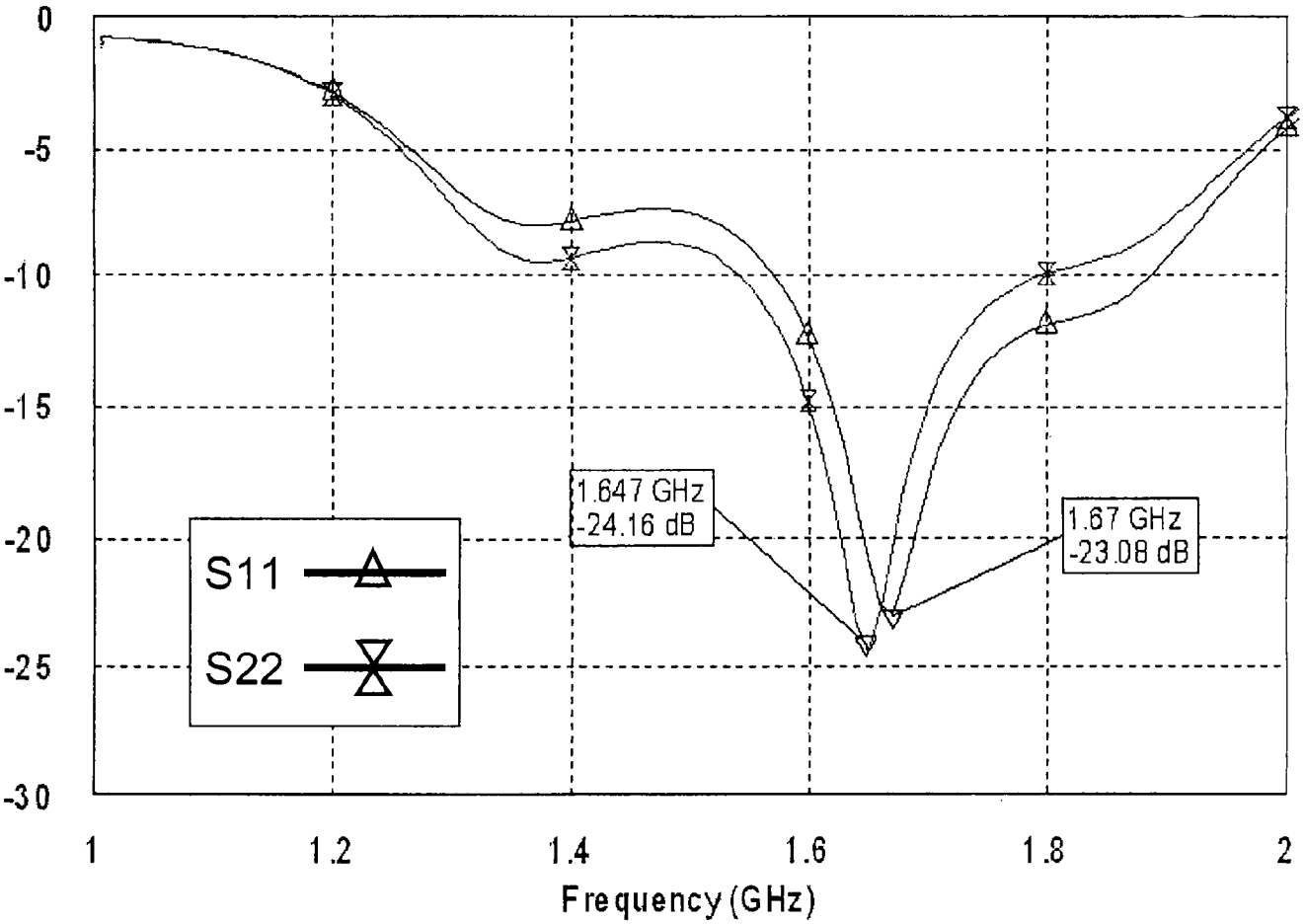
FIG. 31 is a graph showing a frequency characteristic of a reflected signal of the isolator in FIG. 30.

In the case of the conventional isolator shown in FIG. 30, when it is assumed that the amount of refection of the signal inputted from one end of the central conductor L1 is S11 and the amount of refection (=amount of reflection when the signal is outputted from L2) of the signal inputted from one end of the central conductor L2 is S22, the difference in frequency when S11 and S22 become a minimum is on the order of mere 20 MHz.

Figure 21:
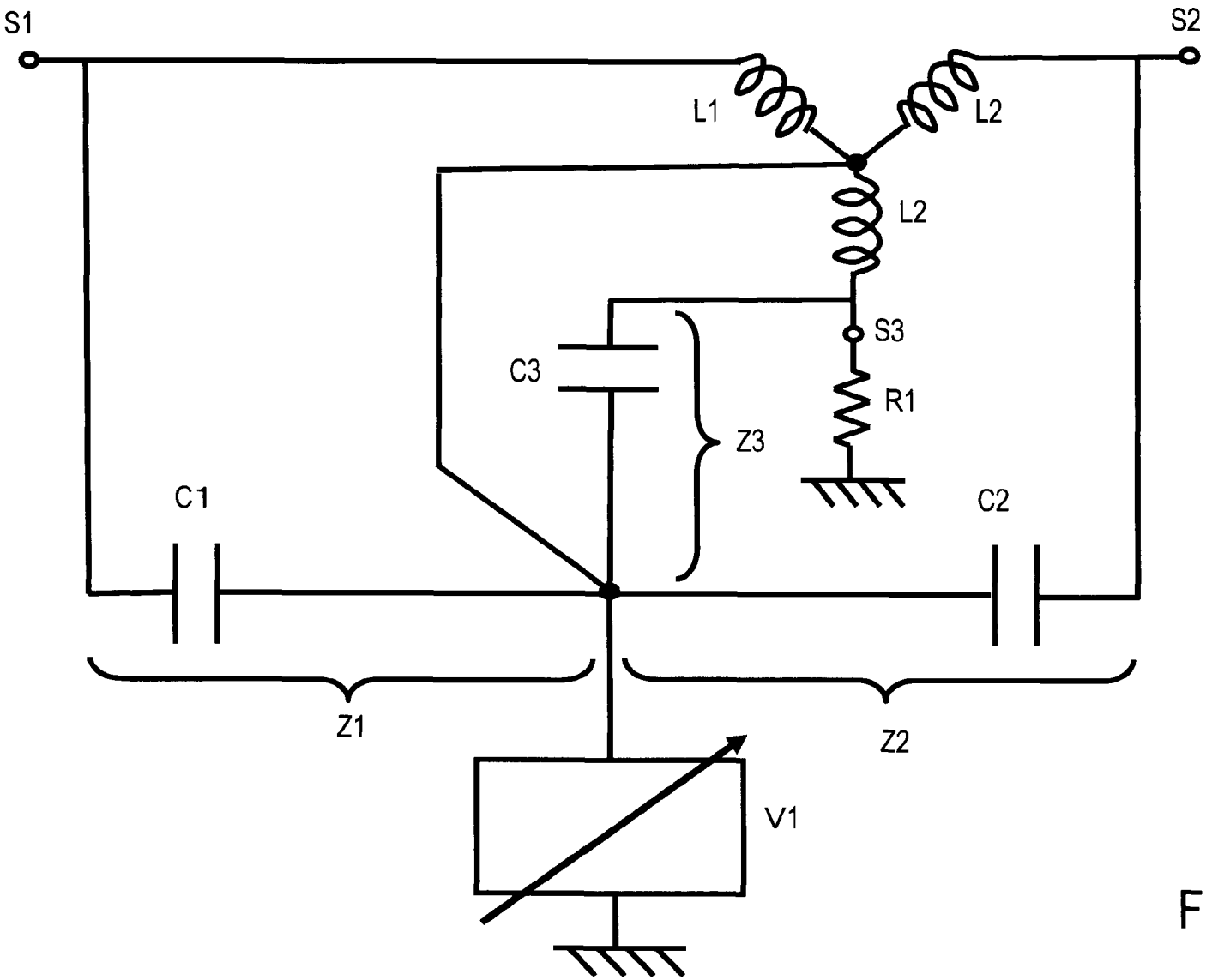
FIG. 21 shows an impedance adjustment part according to a fifteenth embodiment.

However, in the case of the isolator in FIGS. 8 to 12, 14 to 17, which is the configuration of the present invention in which the respective matching capacitors C1, C2 and C3 are connected in series to the variable matching mechanism V1, if there is a variation in impedances Z1, Z2, Z3 (see FIG. 21) of the portions connecting the respective central conductors L1, L2, L3 and the variable matching mechanism V1, the difference in frequencies at which S11 and S22 become a minimum drastically expands compared to that of the conventional isolator and causes passage loss to increase.

Therefore, this embodiment equalizes all the impedances Z1, Z2, Z3 of the portions connecting the respective central conductors L1, L2, L3 and the variable matching mechanism V1, thereby reduces the difference in frequencies at which S11 and S22 become a minimum and suppresses an increase in passage loss. Furthermore, by adopting such a configuration, the impedance between the central conductor and the variable matching mechanism can be adjusted as a total of the impedance of the matching capacitor and the impedance of the portion connecting the matching capacitor and the variable matching mechanism. Therefore, the impedances of the matching capacitors C1, C2, C3 between the central conductors and variable matching mechanism and the impedances Z1', Z2', Z3' of the portion connecting the matching capacitors and the variable matching mechanisms need not be equalized. Therefore, impedances can be easily adjusted and manufacturing cost can also be cut down.

The impedances need not be equal in the strict sense and may include design/manufacturing errors or the like.

Figure 22:
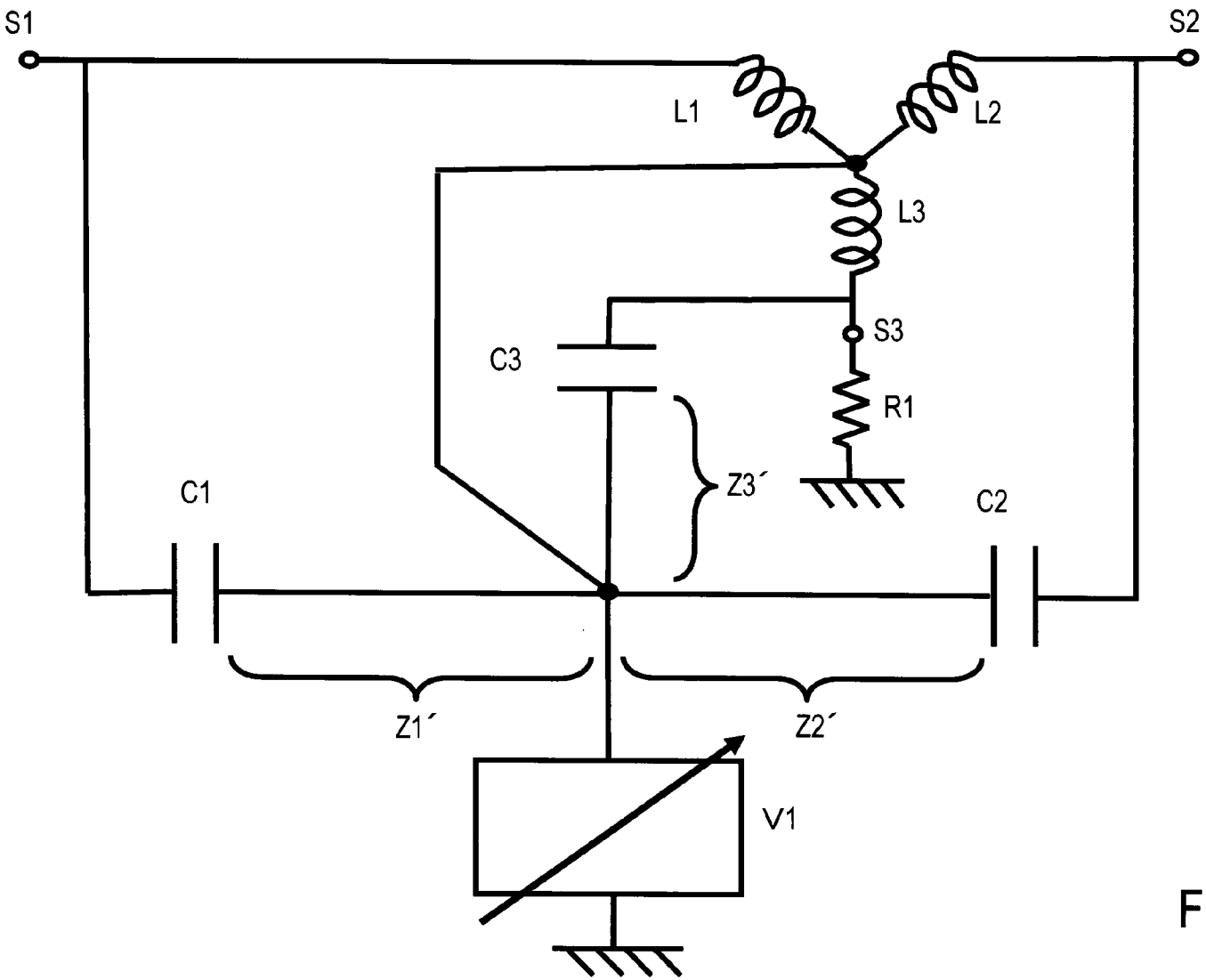
FIG. 22 is another diagram showing the impedance adjustment part according to the fifteenth embodiment.

Furthermore, when the impedances of the matching capacitors C1, C2, C3 can be equalized, it is also possible to equalize all Z1, Z2, Z3 by equalizing all impedances Z1', Z2', Z3' (see FIG. 22) between the matching capacitors C1, C2, C3 and the variable matching mechanism V1. As the method of equalizing the impedances Z1', Z2', Z3', a method of, for example, connecting the portions connecting the matching capacitors C1, C2, C3 and the variable matching mechanism V1 using lines of the same length and the same width.

[Passage Characteristic Data]

Next, passage characteristic data to exhibit the effects of the present invention will be shown.

Figure 23:
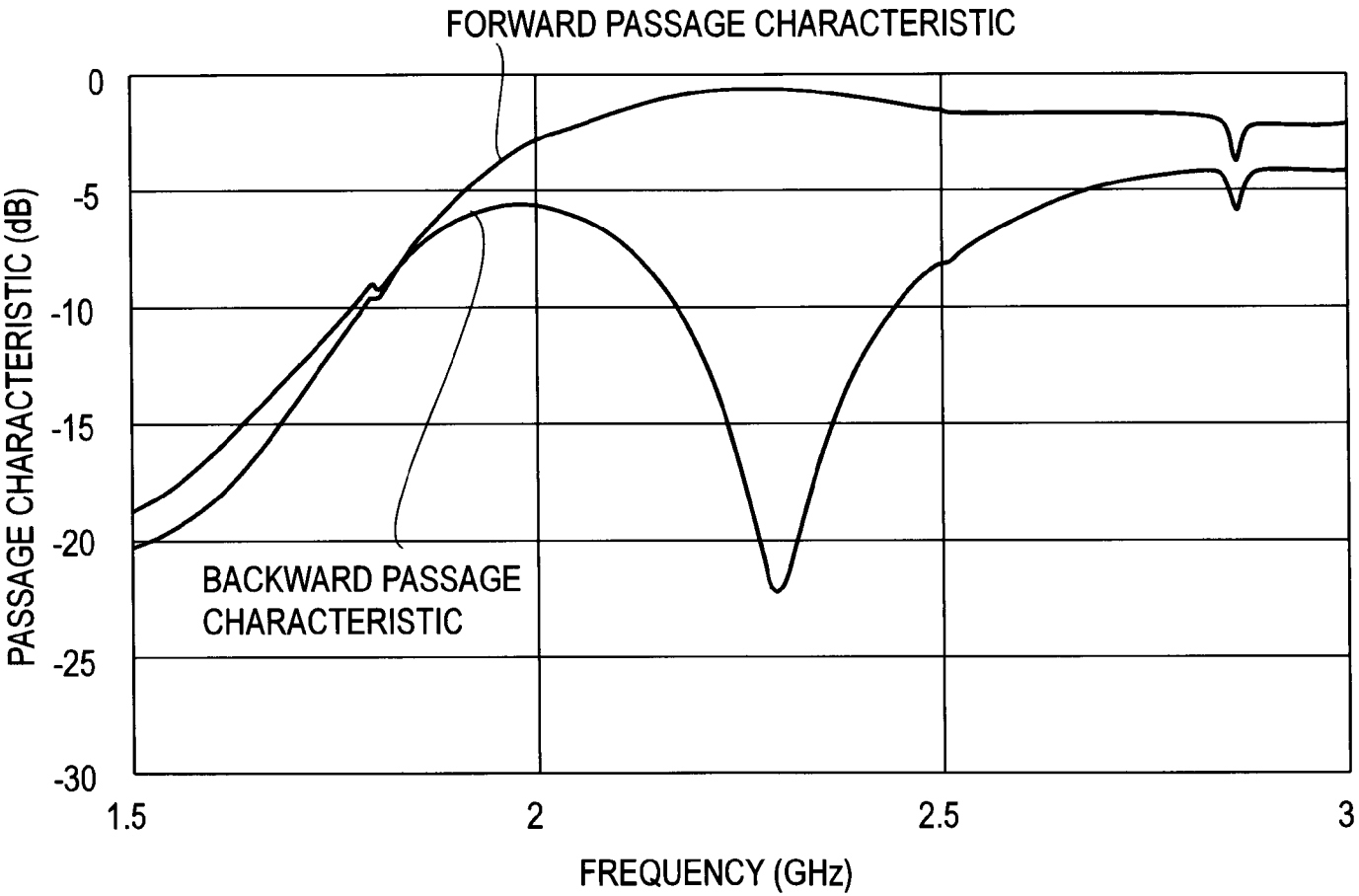
FIG. 23 is a graph showing a passage characteristic of the isolator in FIG. 9.
Figure 24:
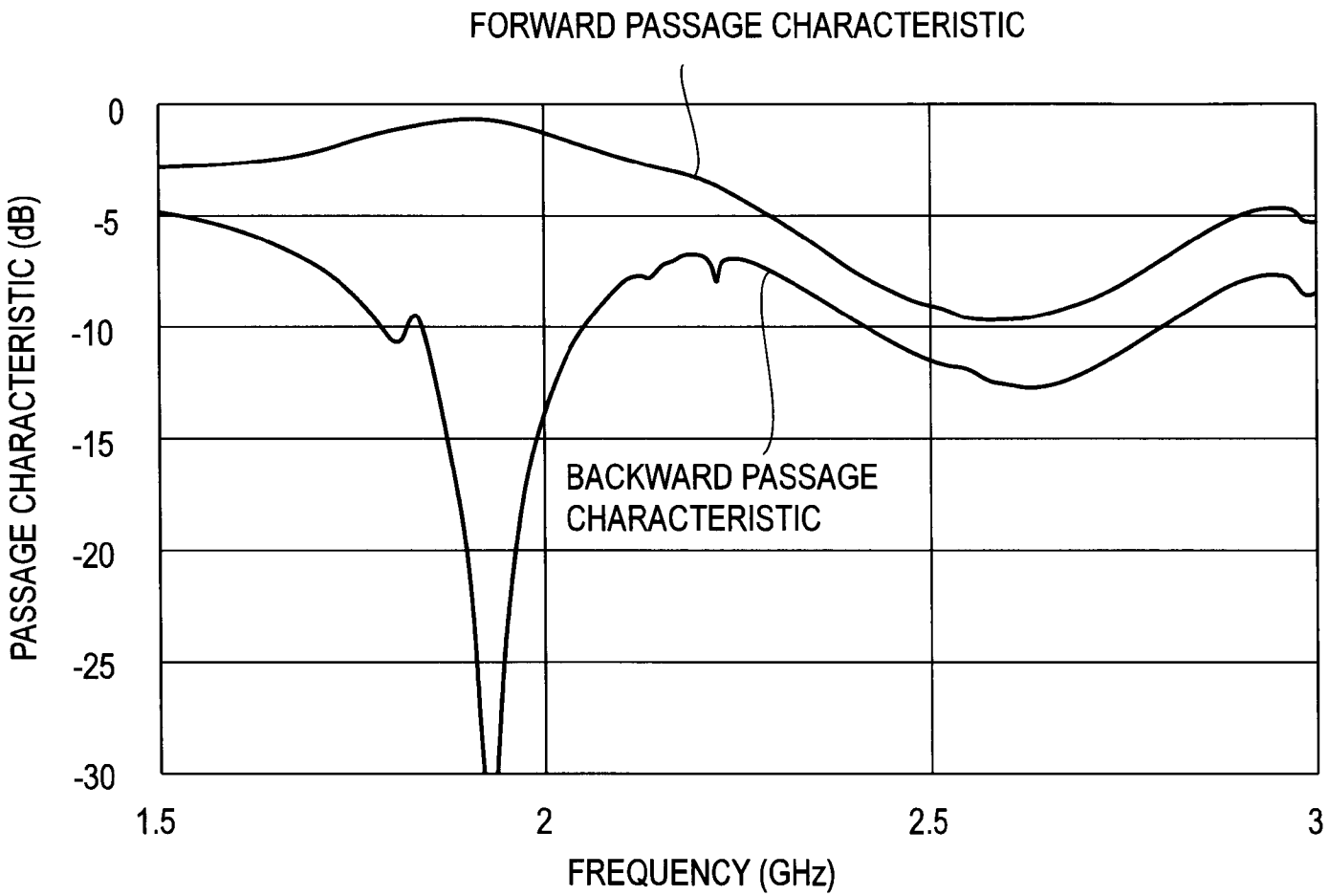
FIG. 24 is a graph showing a passage characteristic of the isolator in FIG. 9.

FIG. 23 and FIG. 24 are graphs showing a passage characteristic of the isolator of FIG. 9 shown in the third embodiment. Suppose for the variable matching mechanism V1, the one in FIG. 4 is used and the capacitance of the capacitor C41 is 1.5 pF.

FIG. 23 shows a passage characteristic when the switch SW1 of the variable matching mechanism V1 is ON. From this figure, it is appreciated that when the switch SW1 is ON, the frequency at which an irreversible property of 20 dB or more is obtained is around 2.3 GHz. On the other hand, FIG. 24 is a passage characteristic when the switch SW1 of the variable matching mechanism V1 is OFF. From this figure, it is appreciated that when the switch SW1 is OFF, the frequency at which an irreversible property of 20 dB or more is obtained is around 1.9 GHz.

That is, through the control of the variable matching mechanism V1, the matching condition changes and the frequency band where the irreversible property of the isolator is obtained changes.

Figure 25:
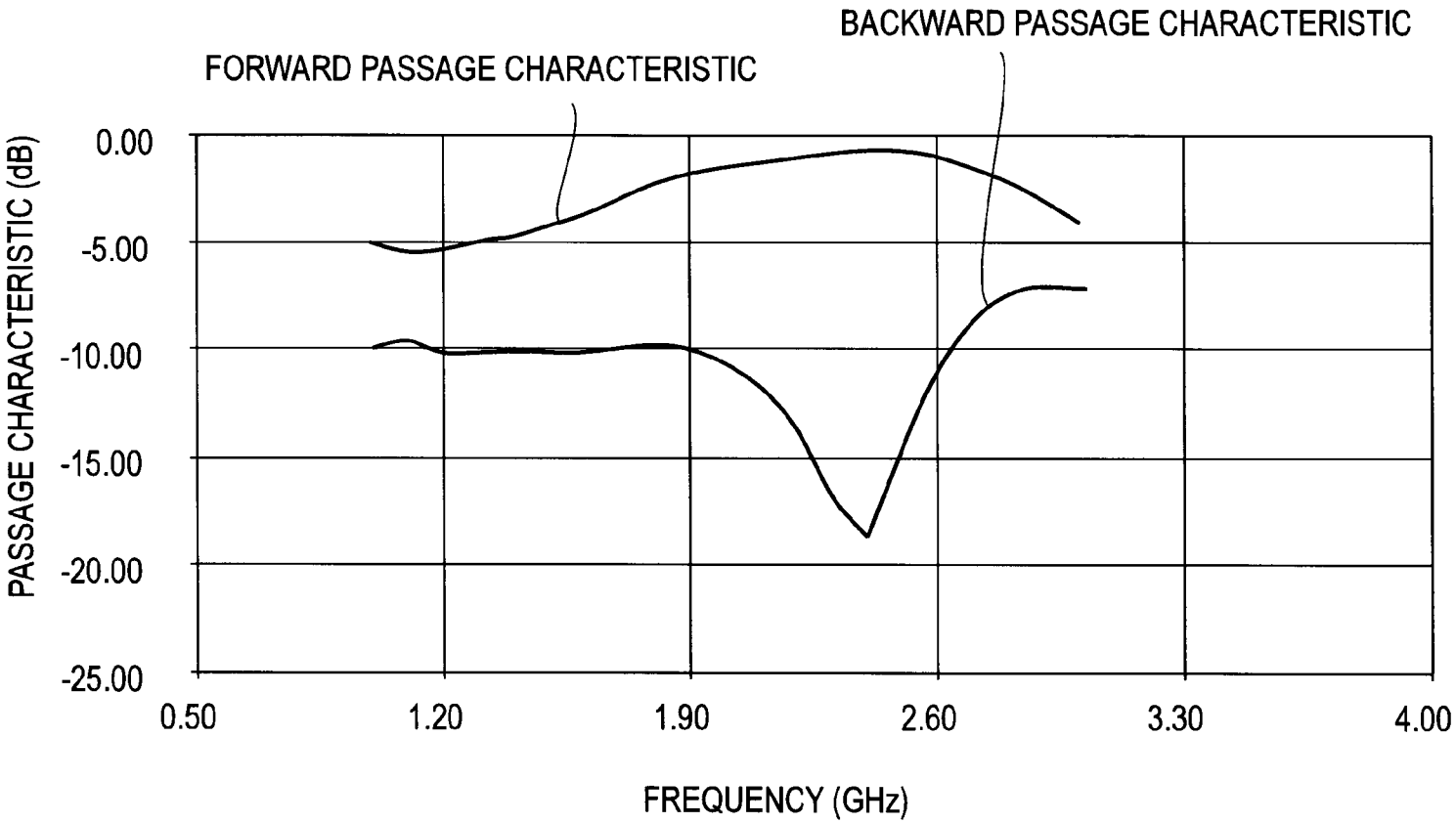
FIG. 25 is a graph showing a passage characteristic when a grounding capacitor (20 pF) is mounted for a variable matching mechanism V1 of the isolator in FIG. 9.
Figure 26:
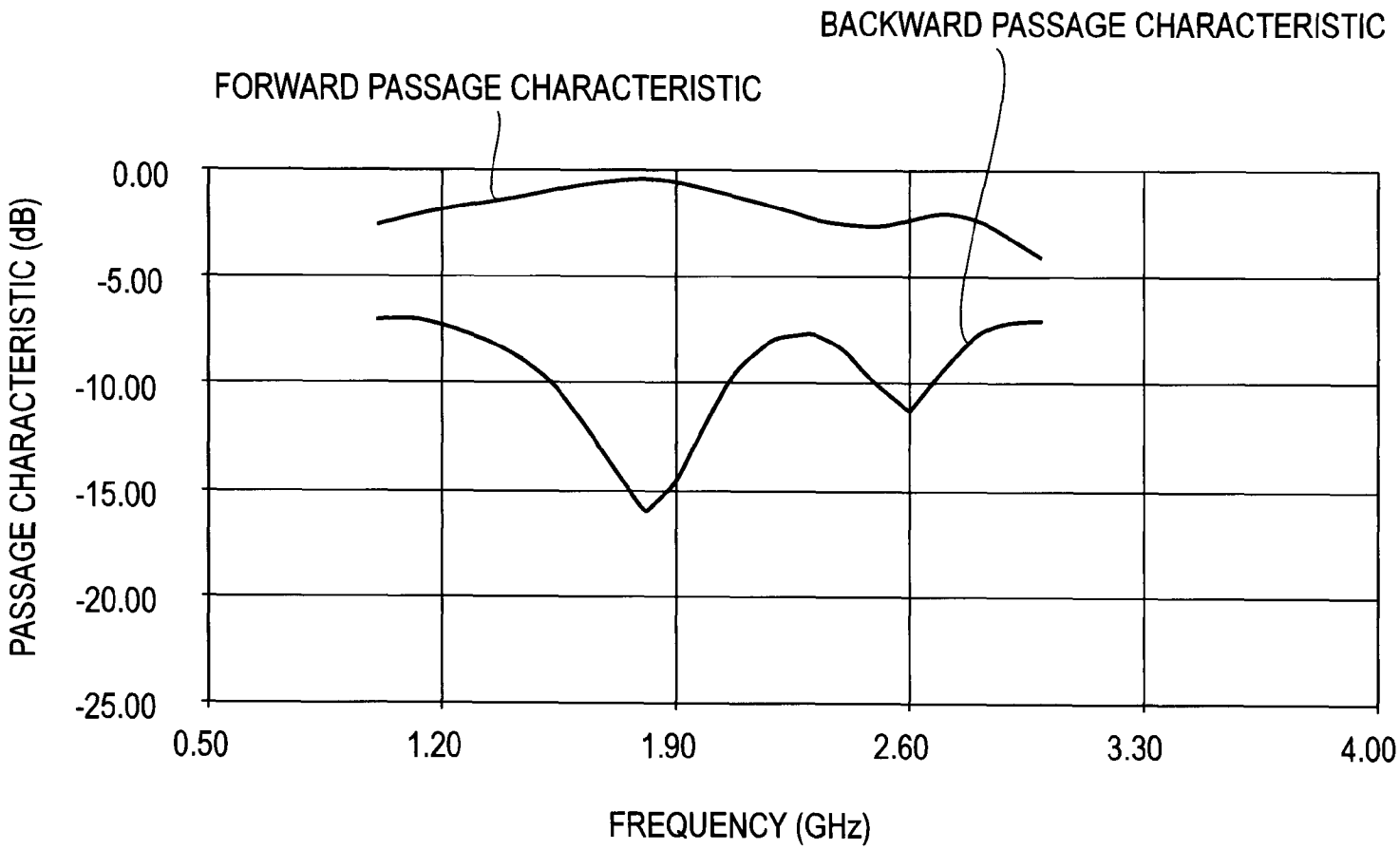
FIG. 26 is a graph showing a passage characteristic when a grounding capacitor (5 pF) is mounted for a variable matching mechanism V1 of the isolator in FIG. 9.

FIG. 25 and FIG. 26 are graphs showing a passage characteristic when a grounding capacitor is mounted in the variable matching mechanism V1 of the isolator in FIG. 9 shown in the third embodiment. Here, FIG. 25 shows a passage characteristic when a grounding capacitor having a capacitance of 20 pF is mounted in the variable matching mechanism V1 and FIG. 26 shows a passage characteristic when a grounding capacitor having a capacitance of 5 pF is mounted in the variable matching mechanism V1. For the variable matching mechanism V1, the one in FIG. 4 is used and suppose the capacitance of the capacitor C41 is 1.5 pF. Furthermore, FIG. 25 and FIG. 26 show the passage characteristic when the switch SW1 is ON.

When no grounding capacitor is mounted, the passage characteristic at a frequency of 2.4 GHz was −0.94 dB (passage loss 0.94 dB) (FIG. 23). On the other hand, the passage characteristic at the peak of isolation (frequency 2.4 GHz) when the grounding capacitor having a capacitance of 20 pF is mounted in the variable matching mechanism V1 becomes −0.7 dB (passage loss 0.7 dB) (FIG. 25). Furthermore, the passage characteristic at the peak of isolation (frequency 1.8 GHz) when the grounding capacitor having a capacitance of 5 pF is mounted in the variable matching mechanism V1 becomes −0.39 dB (passage loss 0.39 dB) (FIG. 26). In this way, mounting the grounding capacitor allows the passage loss to be reduced.

Figure 27:
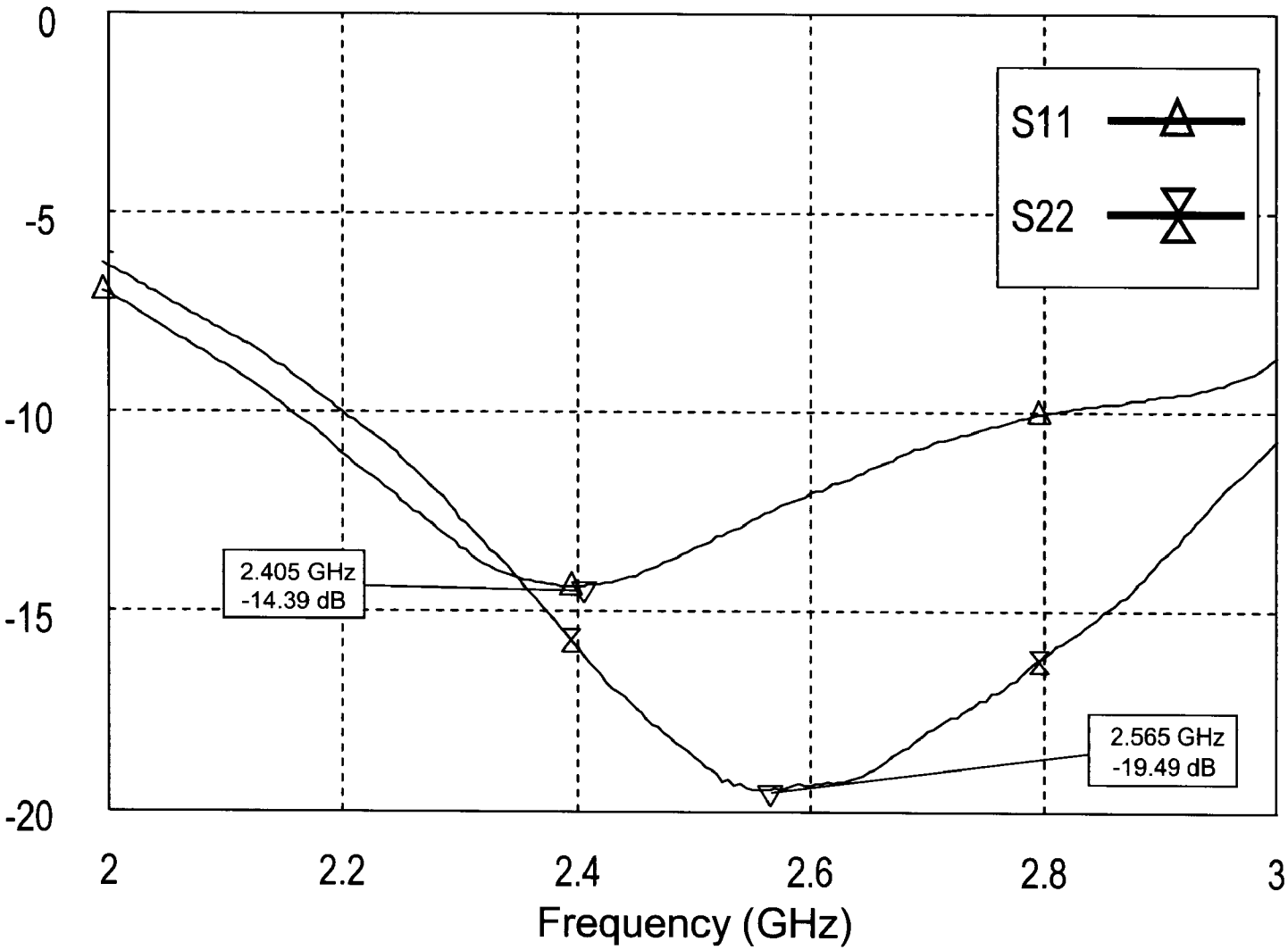
FIG. 27 is a graph showing a frequency characteristic of a reflected signal when impedance in the adjustment part in FIG. 22 is not equalized.
Figure 28:
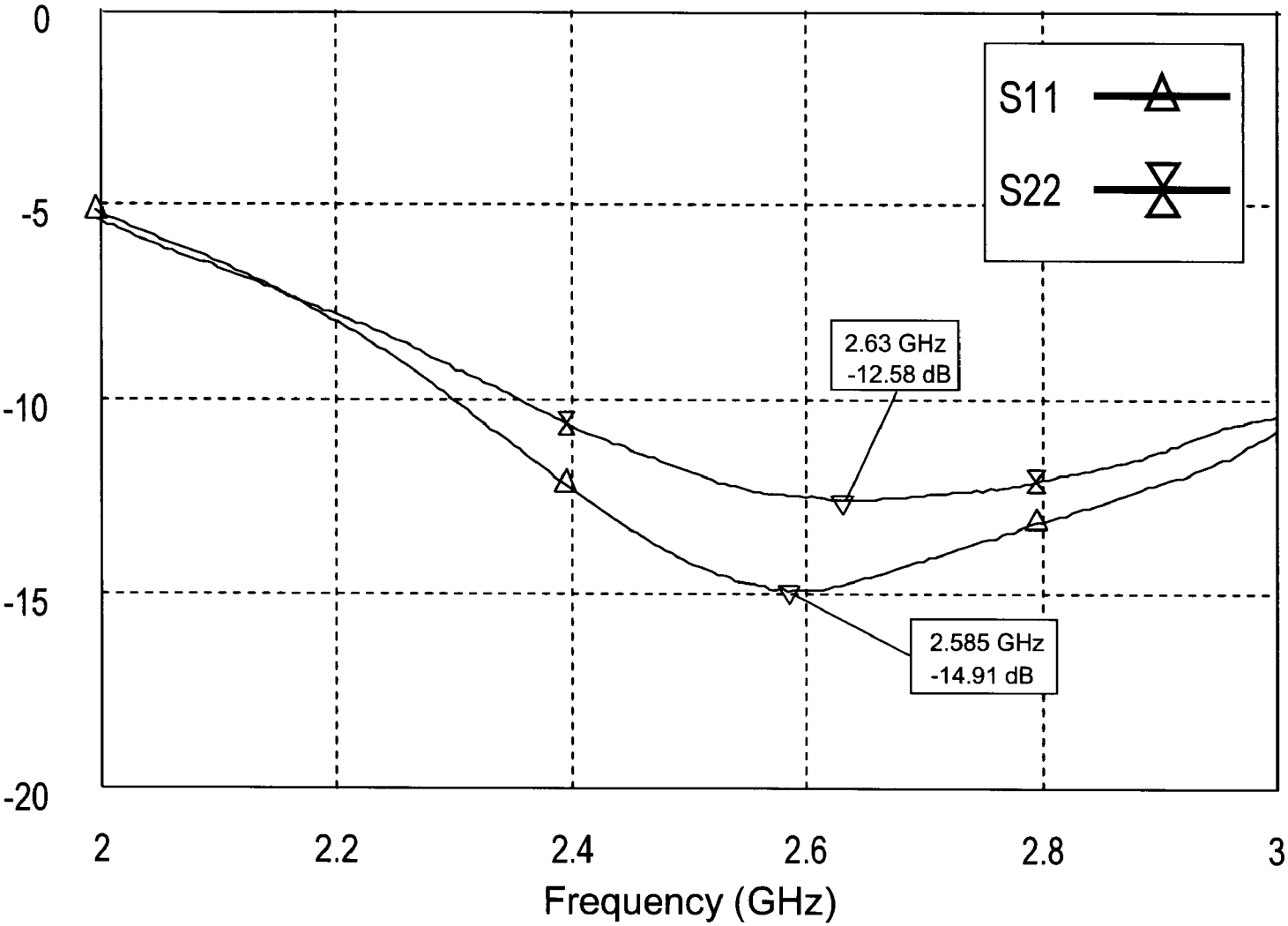
FIG. 28 is a graph showing a frequency characteristic of a reflected signal when impedance in the adjustment part in FIG. 22 is equalized.
Figure 29:
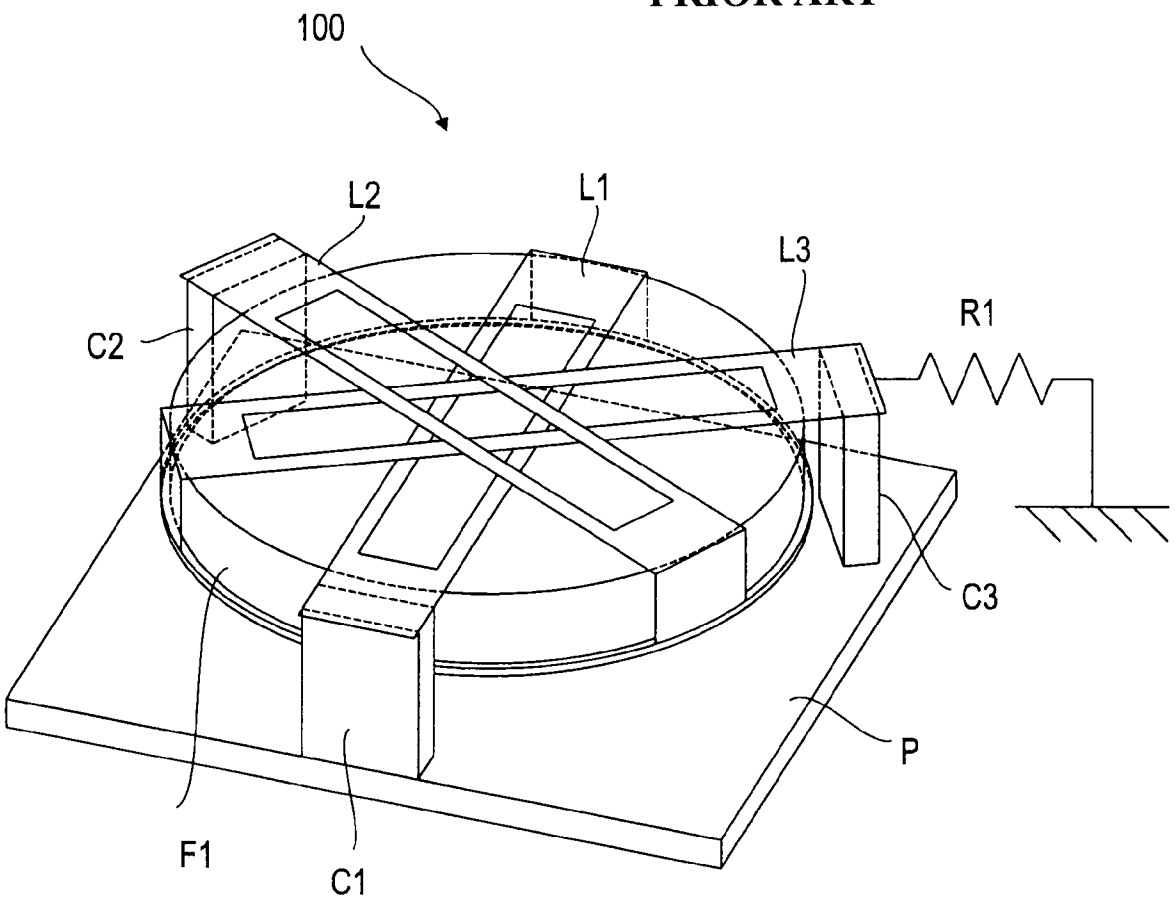
FIG. 29 PRIOR ART
FIG. 29 is a see-through perspective view illustrating the inner structure of a conventional lumped-element type isolator.

FIG. 27 is an example of the frequency characteristic of the amount of reflection S11 of the signal inputted from one end of the central conductor L1 and the amount of reflection S22 of the signal inputted from one end of the central conductor L2 in the isolator of the third embodiment shown in FIG. 9 when the impedances Z1', Z2', Z3' (see FIG. 22) are not equal and shows that the difference in frequencies at which S11 and S22 become a minimum expands to approximately 150 MHz. On the other hand, FIG. 28 is an example of the frequency characteristics of S11 and S22 in the case of the fifteenth embodiment where all the impedances Z1', Z2', Z3' are equalized and shows that the difference in frequencies at which S11 and S22 become a minimum is approximately 45 MHz, that is, there is an effect of drastic reduction of the difference compared to the case where the impedances are not equal.

The present invention is not limited to the above described embodiments. For example, the above described embodiments have explained cases where the present invention is applied to the lumped-element type isolator, which is an example of the irreversible circuit element, but it can also be a configuration in which the present invention is applied to a lumped-element type circulator, for example. In the configuration in this case, the termination resistor R1 shown in the above described embodiments is not provided. Furthermore, it goes without saying that the embodiments can be modified as appropriate within a range not departing from the essence of the present invention.

INDUSTRIAL APPLICABILITY

Examples of the application fields of the present invention may include communication equipment used in a wideband, for example, an isolator or a circulator used in a cellular phone terminal apparatus used in a dual band.

What is claimed is:

1. An irreversible circuit element comprising:
   - a magnetic substance;
   - a plurality of central conductors, one ends of which are connected to different input/output ports, arranged on the magnetic substance so as to intersect each other while being insulated from each other;
   - a first conductor connected to the other ends of all the central conductors;
   - a second conductor;
   - a plurality of matching capacitors each capacitor is located between the second conductor and the one end of a corresponding one of the plurality of central conductors; and
   - a first variable matching mechanism, one end of which is connected or integrated with the second conductor, capable of changing reactance between the one end and the other end thereof, the first variable matching mechanism being connected in series to each of the plurality of matching capacitors.

2. The irreversible circuit element according to claim 1, in which the other end of the first variable matching mechanism and the first conductor are electrically grounded respectively.

3. The irreversible circuit element according to claim 1, in which the first conductor and the second conductor are connected or integrated with each other,
   - a grounding capacitor is connected in series to the other end of the first variable matching mechanism, and
   - the other end of the grounding capacitor is electrically grounded.

4. The irreversible circuit element according to claim 1, further comprising a second variable matching mechanism, one end of which is connected or integrated with the first conductor, the other end of which is connected or integrated with the second conductor, capable of changing reactance between the one end and the other end, in which a grounding capacitor is connected in series to the other end of the first variable matching mechanism and the other end of the grounding capacitor is electrically grounded.

5. The irreversible circuit element according to claim 1, further comprising a second variable matching mechanism, one end of which is connected or integrated with the first conductor, capable of changing reactance between the one end and the other end, in which the other end of the first variable matching mechanism is connected to the first conductor, a grounding capacitor is connected in series to the other end of the second variable matching mechanism, and the other end of the grounding capacitor is electrically grounded.

6. The irreversible circuit element according to claim 1, further comprising a second variable matching mechanism, one end of which is connected or integrated with the first conductor, capable of changing reactance between the one end and the other end, in which a first grounding capacitor is connected in series to the other end of the first variable matching mechanism and the other end of the first grounding capacitor is electrically grounded, and a second grounding capacitor is connected in series to the other end of the second variable matching mechanism and the other end of the second grounding capacitor is electrically grounded.

7. The irreversible circuit element according to claim 1, in which the variable matching mechanism is a circuit in which a circuit element having predetermined reactance and a switch are connected parallel to each other and reactance between one end of connection between the circuit element and the switch and the other end of connection is changed by turning ON/OFF the switch.

8. The irreversible circuit element according to claim 1, in which the variable matching mechanism is a circuit in which one or more series circuits comprising first circuit elements having predetermined reactance and switches connected in series to each other and a second circuit element having predetermined reactance are connected in parallel to each other and reactance between the one end of connection between the series circuits and the second circuit element and the other end of connection is changed by turning ON/OFF each of the switches.

9. The irreversible circuit element according to claim 1, in which the variable matching mechanism is a circuit comprising variable capacitors whose capacitance is variable, capable of changing reactance between one end and the other end of the variable capacitor by changing the capacitance of the variable capacitor.

10. The irreversible circuit element according to claim 9, in which at least some of the variable capacitors are capacitors comprising the first conductor and the second conductor and capacitance thereof is changed by mechanically changing the distance between the first conductor and the second conductor.

11. The irreversible circuit element according to claim 1, further comprising a second variable matching mechanism, one end of which is connected or integrated with the first conductor, the other end of which is electrically grounded, capable of changing reactance between the one end and the other end, in which the other end of the first variable matching mechanism is electrically grounded.

12. The irreversible circuit element according to claim 11, in which each of the variable matching mechanisms is a circuit in which one or more series circuits comprising a first circuit element having predetermined reactance and a switch connected in series to each other and a second circuit element having predetermined reactance are connected in parallel to each other, reactance between one end of connection between the series circuits and the second circuit element and the other end of connection is changed by turning ON/OFF the switch, and the first circuit element and the second circuit element each comprise a capacitor on a side closest to the other end of each of the variable matching mechanisms.

13. The irreversible circuit element according to claim 1, further comprising a second variable matching mechanism, one end of which is connected or integrated with the first conductor and the other end of which is electrically grounded, capable of changing reactance between the one end and the other end, in which the other end of the first variable matching mechanism is connected to the first conductor.

14. The irreversible circuit element according to claim 13, in which the second variable matching mechanism is a circuit in which one or more series circuits comprising a first circuit element having predetermined reactance and a switch connected in series to each other and a second circuit element having predetermined reactance are connected in parallel to each other and reactance between one end of connection between the series circuits and the second circuit element and the other end of connection is changed by turning ON/OFF the switch, and the first circuit element and the second circuit element each comprise a capacitor on a side closest to the other end of each of the second variable matching mechanism.

15. The irreversible circuit element according to claim 1, in which all impedances between the respective central conductors and the first variable matching mechanism are equal.

16. The irreversible circuit element according to claim 15, in which the other end of the first variable matching mechanism and the first conductor are electrically grounded respectively.

17. The irreversible circuit element according to claim 15, in which the first conductor and the second conductor are connected or integrated with each other, and the other end of the first variable matching mechanism is electrically grounded.

18. The irreversible circuit element according to claim 15, further comprising a second variable matching mechanism, one end of which is connected or integrated with the first conductor, the other end of which is connected or integrated with the second conductor, capable of changing reactance between the one end and the other end, in which the other end of the first variable matching mechanism is electrically grounded.

19. The irreversible circuit element according to claim 15, further comprising a second variable matching mechanism, one end of which is connected or integrated with the first conductor and the other end of which is electrically grounded, capable of changing reactance between the one end and the other end, in which the other end of the first variable matching mechanism is connected to the first conductor.

20. The irreversible circuit element according to claim 15, further comprising a second variable matching mechanism, one end of which is connected or integrated with the first conductor, the other end of which is electrically grounded, capable of changing reactance between the one end and the other end, in which the other end of the first variable matching mechanism is electrically grounded.

21. The irreversible circuit element according to claim 15, in which the first conductor and the second conductor are connected or integrated with each other, a grounding capacitor is connected in series to the other end of the first variable matching mechanism, and the other end of the grounding capacitor is electrically grounded.

22. The irreversible circuit element according to claim 15, further comprising a second variable matching mechanism, one end of which is connected or integrated with the first conductor, the other end of which is connected or integrated with the second conductor, capable of changing reactance between the one end and the other end, in which a grounding capacitor is connected in series to the other end of the first variable matching mechanism and the other end of the grounding capacitor is electrically grounded.

23. The irreversible circuit element according to claim 15, further comprising a second variable matching mechanism, one end of which is connected or integrated with the first conductor, capable of changing reactance between the one end and the other end, in which the other end of the first variable matching mechanism is connected to the first conductor, a grounding capacitor is connected in series to the other end of the second variable matching mechanism, and the other end of the grounding capacitor is electrically grounded.

24. The irreversible circuit element according to claim 15, further comprising a second variable matching mechanism, one end of which is connected or integrated with the first conductor, capable of changing reactance between the one end and the other end, in which a first grounding capacitor is connected in series to the other end of the first variable matching mechanism and the other end of the first grounding capacitor is electrically grounded, and a second grounding capacitor is connected in series to the other end of the second variable matching mechanism and the other end of the second grounding capacitor is electrically grounded.

25. The irreversible circuit element according to claim 1, in which all impedances between the respective matching capacitors and the first variable matching mechanism are equal.

26. The irreversible circuit element according to claim 25, in which the other end of the first variable matching mechanism and the first conductor are electrically grounded respectively.

27. The irreversible circuit element according to claim 25, in which the first conductor and the second conductor are connected or integrated with each other, and the other end of the first variable matching mechanism is electrically grounded.

28. The irreversible circuit element according to claim 25, further comprising a second variable matching mechanism, one end of which is connected or integrated with the first conductor, the other end of which is connected or integrated with the second conductor, capable of changing reactance between the one end and the other end, in which the other end of the first variable matching mechanism is electrically grounded.

29. The irreversible circuit element according to claim 25, further comprising a second variable matching mechanism, one end of which is connected or integrated with the first conductor and the other end of which is electrically grounded, capable of changing reactance between the one end and the other end, in which the other end of the first variable matching mechanism is connected to the first conductor.

30. The irreversible circuit element according to claim 25, further comprising a second variable matching mechanism, one end of which is connected or integrated with the first conductor, the other end of which is electrically grounded, capable of changing reactance between the one end and the other end, in which the other end of the first variable matching mechanism is electrically grounded.

31. The irreversible circuit element according to claim 25, in which the first conductor and the second conductor are connected or integrated with each other, a grounding capacitor is connected in series to the other end of the first variable matching mechanism, and the other end of the grounding capacitor is electrically grounded.

32. The irreversible circuit element according to claim 25, further comprising a second variable matching mechanism, one end of which is connected or integrated with the first conductor, the other end of which is connected or integrated with the second conductor, capable of changing reactance between the one end and the other end, in which a grounding capacitor is connected in series to the other end of the first variable matching mechanism and the other end of the grounding capacitor is electrically grounded.

33. The irreversible circuit element according to claim 25, further comprising a second variable matching mechanism, one end of which is connected or integrated with the first conductor, capable of changing reactance between the one end and the other end, in which the other end of the first variable matching mechanism is connected to the first conductor, a grounding capacitor is connected in series to the other end of the second variable matching mechanism, and the other end of the grounding capacitor is electrically grounded.

34. The irreversible circuit element according to claim 25, further comprising a second variable matching mechanism, one end of which is connected or integrated with the first conductor, capable of changing reactance between the one end and the other end, in which a first grounding capacitor is connected in series to the other end of the first variable matching mechanism and the other end of the first grounding capacitor is electrically grounded, and a second grounding capacitor is connected in series to the other end of the second variable matching mechanism and the other end of the second grounding capacitor is electrically grounded.

35. The irreversible circuit element according to claim 1, in which the first conductor and the second conductor are connected or integrated with each other, and the other end of the first variable matching mechanism is electrically grounded.

36. The irreversible circuit element according to claim 1, further comprising a second variable matching mechanism, one end of which is connected or integrated with the first conductor, the other end of which is connected or integrated with the second conductor, capable of changing reactance between the one end and the other end, in which the other end of the first variable matching mechanism is electrically grounded.

37. The irreversible circuit element according to claim 35 or 36, in which the first variable matching mechanism is a circuit in which one or more series circuits comprising a first circuit element having predetermined reactance and a switch connected in series to each other and a second circuit element having predetermined reactance are connected in parallel to each other and reactance between one end of connection between the series circuits and the second circuit element and the other end of connection is changed by turning ON/OFF the switch, and the first circuit element and the second circuit element each comprise a capacitor on a side closest to the other end of each of the first variable matching mechanism.

* * * * *